US008773320B2

(12) United States Patent
Park et al.

(10) Patent No.: US 8,773,320 B2
(45) Date of Patent: Jul. 8, 2014

(54) PLANAR CRLH ANTENNA

(75) Inventors: Wee Sang Park, Pohang-si (KR); Jae Woo Ko, Uiwang-si (KR); Joon Hyun Baek, Seoul (KR); Dae Woong Woo, Daegu (KR)

(73) Assignees: Samsung Electronics Co., Ltd., Suwon-si (KR); Postech Academy-Industry Foundation, Pohang-si (KR)

( * ) Notice: Subject to any disclaimer, the term of this patent is extended or adjusted under 35 U.S.C. 154(b) by 470 days.

(21) Appl. No.: 13/132,130

(22) PCT Filed: Dec. 1, 2009

(86) PCT No.: PCT/KR2009/007107

§ 371 (c)(1),
(2), (4) Date: Jun. 1, 2011

(87) PCT Pub. No.: WO2010/064826

PCT Pub. Date: Jun. 10, 2010

(65) Prior Publication Data

US 2011/0234465 A1 Sep. 29, 2011

(30) Foreign Application Priority Data

Dec. 2, 2008 (KR) ..... 10-2008-0120977
Feb. 25, 2009 (KR) ..... 10-2009-0015923

(51) Int. Cl.
*H01Q 13/10* (2006.01)

(52) U.S. Cl.
USPC ..... 343/767; 343/722

(58) Field of Classification Search
USPC ..... 343/767, 722, 770, 846
See application file for complete search history.

(56) References Cited

U.S. PATENT DOCUMENTS

| | | | | |
|---|---|---|---|---|
| 4,326,180 | A * | 4/1982 | Ferri | 333/246 |
| 6,593,891 | B2 * | 7/2003 | Zhang | 343/767 |
| 2003/0076259 | A1 * | 4/2003 | Zhang | 343/700 MS |
| 2007/0176827 | A1 | 8/2007 | Itoh et al. | |
| 2008/0048917 | A1 | 2/2008 | Achour et al. | |
| 2008/0258981 | A1 | 10/2008 | Achour et al. | |
| 2010/0123635 | A1 * | 5/2010 | Lopez et al. | 343/722 |
| 2011/0234465 | A1 * | 9/2011 | Park et al. | 343/767 |

OTHER PUBLICATIONS

Wu. Chien-Hung, "A Novel Small Planar Antenna Utilizing Cascaded Right/Left-Handed Transmission Lines", In: 2007 IEEE Antennas and Propagation Society International Symposium. Jun. 9-15, 2007, Honolulu HI. USA. pp. 1889-1892.

* cited by examiner

*Primary Examiner* — Thien M Le
(74) *Attorney, Agent, or Firm* — Jefferson IP Law, LLP

(57) ABSTRACT

The present invention relates to a planar composite right/left handed (CRLH) antenna, comprising: a substrate body which is made of dielectric materials, and which has a planer structure; a radiation line which is disposed on one side of the substrate body, and which is bent to form a slot for exposing a predetermined width of the substrate body through both ends thereof, and which resonates at a predetermined frequency band when fed; and a feeder line which is disposed on the outer side of the substrate body, which extends across the slot, and which feeds electric power to the radiation line. The planar CRLH antenna of the present invention is small in size, and expands a radiation area, thereby expanding an available frequency band, or using a dual frequency band.

15 Claims, 28 Drawing Sheets

(a)

(b)

(a) Electric field distribution (b) Current distribution (a)

(b)

(a) Electric field distribution (b) Current distribution (a) Low frequency mode (b) High frequency mode (a) xy pattern (b) xz pattern (c) yz pattern

PLANAR CRLH ANTENNA

BACKGROUND OF THE INVENTION

1. Field of the Invention

The present invention relates to an antenna, and more particularly, to a planar meta-material (MTM) slot antenna operating in a Composite Right/Left Handed (CRLH) resonator.

2. Description of the Related Art

In recent years, a mobile terminal tends to be small in size according to a request of consumers. Accordingly, an antenna mounted in the mobile terminal is gradually miniaturized. In general, the antenna resonates at a single frequency band to transmit and receive an electromagnetic wave of a corresponding frequency band. Research to implement miniaturization of an antenna has been actively performed. An MTM antenna is recently attracting attention. Because the MTM antenna may resonate at a frequency band enabling a phase constant β of an electromagnetic wave to be zero using resonant characteristics of a Left-Handed (LH) structure regardless of an electric length, it is profitable to miniaturization. Accordingly, various MTM antennas have been reported, which have the small size less than approximately 1/10 wavelength.

However, since the foregoing MTM antenna resonates at a frequency band with a width less than 10% of an entire band, for example, it is difficult to use a Wideband Code Division Multiple Access (WCDMA) requiring a frequency band with a width of 12.5% of the entire band. That is, although it is possible to miniaturize the MTM antenna, a frequency bandwidth for resonation is narrow.

SUMMARY OF THE INVENTION

The present invention has been made in view of the above problems, and provides a planar CRLH antenna. In accordance with an aspect of the present invention, a planar CRLH antenna, includes: a substrate body which is made of dielectric materials, and which has a planer structure; a radiation line which is disposed on one side of the substrate body, and which is bent to form a slot for exposing a predetermined width of the substrate body through both ends thereof, and which resonates at a predetermined frequency band when fed; and a feeder line which is disposed on the other side of the substrate body, which extends across the slot, and which feeds electric power to the radiation line.

In a planar CRLH antenna according to the present invention, the feeder line includes: a resonation line extending across the slot, overlapping with the radiation line at both ends thereof, and resonating at a frequency band different from the frequency band when electric power is fed; and a matching line formed in the substrate body as the radiation being bent, being disposed from the radiation line to extend to a device open region connecting with the slot, providing electric power to the radiation line and the resonation line, and matching impedance of the radiation line with a preset value.

Therefore, in a planar CRLH antenna according to the present invention, it may implement miniaturization and expand a radiation area to expand an available frequency band. Further, the present invention may easily adjust impedance matching in the planar CRLH antenna. In addition, a user may use a dual frequency band in the planar CRLH antenna.

BRIEF DESCRIPTION OF THE DRAWINGS

The objects, features and advantages of the present invention will be more apparent from the following detailed description in conjunction with the accompanying drawings, in which.

DETAILED DESCRIPTION OF EXEMPLARY EMBODIMENTS

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

Figure 1:
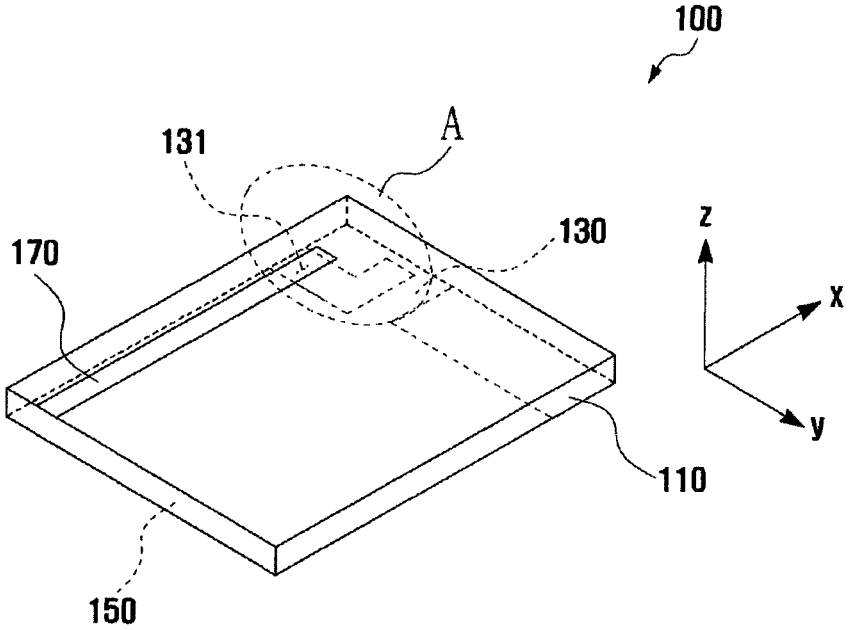
FIG. 1 is a view illustrating a structure of a planar CRLH antenna according to a first embodiment of the present invention.
Figure 1:
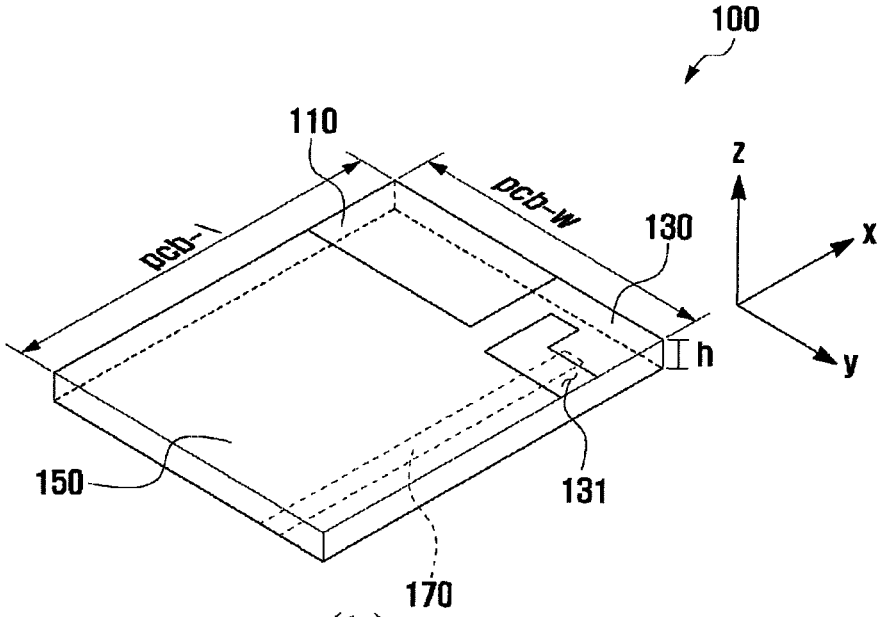
Figure 2:
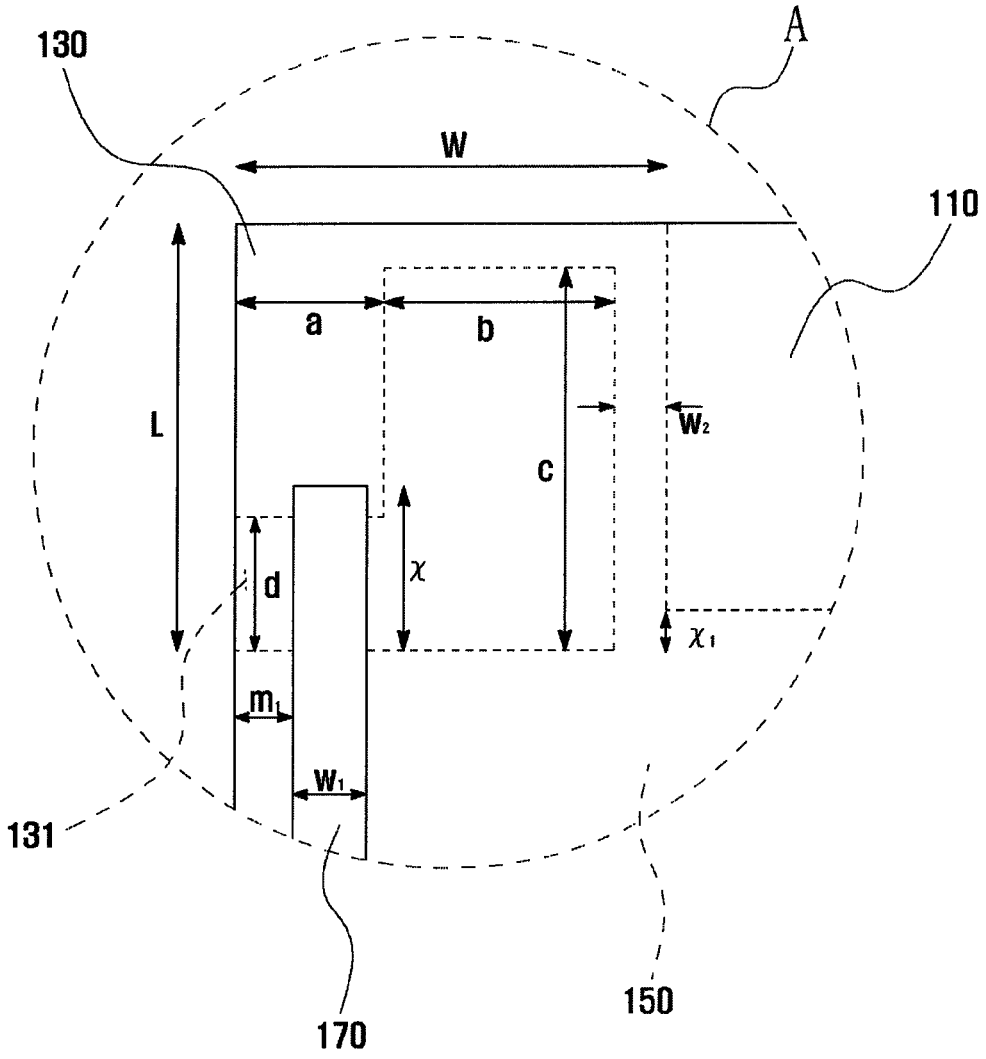
FIG. 2 is an enlarged view illustrating an area 'A' shown in FIG. 1.
Figure 3:
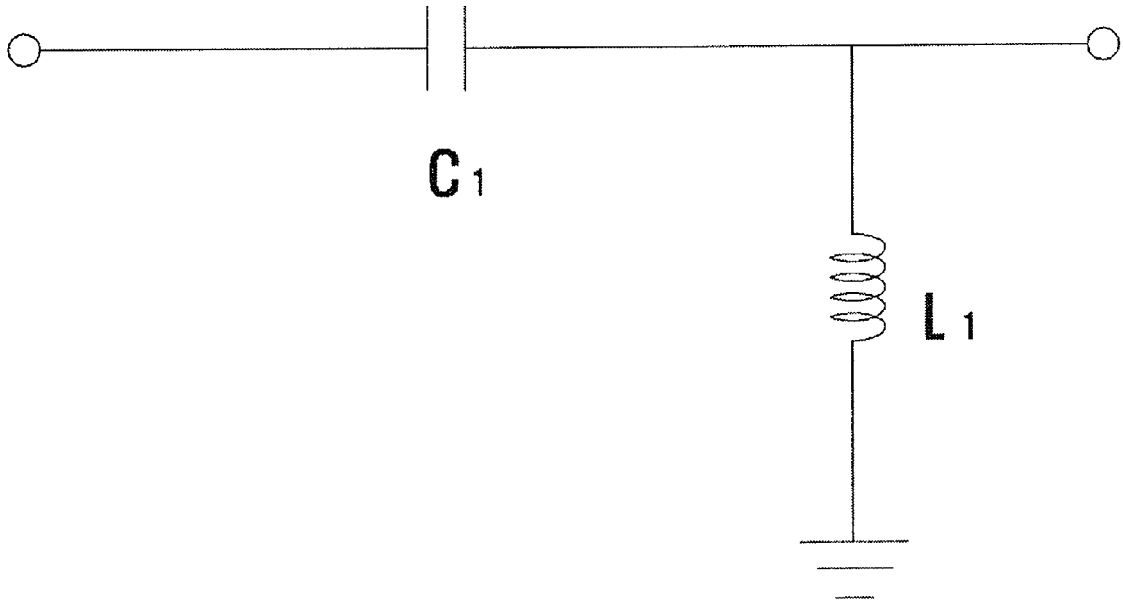
FIG. 3 is a circuitry diagram illustrating an equivalent circuit of FIG. 1.

FIG. 1 is a view illustrating a structure of a planar CRLH antenna according to a first embodiment of the present invention. FIG. 1(*a*) is a perspective plan view of the planar CRLH antenna. FIG. 1(*b*) is a perspective rear view of the planar CRLH antenna. FIG. 2 is an enlarged view illustrating an area 'A' area shown in FIG. 1. FIG. 3 is a circuitry diagram illustrating an equivalent circuit of FIG. 1. In this case, it is assumed that the planar CRLH antenna according to an embodiment of the present is implemented by a Printed Circuit Board (PCB).

Referring to FIG. 1 and FIG. 2, a planar CRLH antenna 100 according to an embodiment of the present invention, namely, LH-slot antenna includes a substrate body 110, a radiation line 130, a ground unit 150, and a feeder line 170.

The substrate body 110 functions as a support in the planar CRLH antenna 100. The substrate body 110 has a planar structure. Further, the substrate body 110 is made of dielectric materials.

The radiation line 130 functions to substantially transmit and receive an electromagnetic wave in the planar CRLH antenna 100. The radiation line 130 is disposed at a lower side of the substrate body 110. In this case, the radiation line 130 may be formed on a surface of the substrate body 110 through patterning metal materials having magnetism. Moreover, the radiation line 130 consists of a Left-Handed Transmission Line (LH-TL) of an LH structure having negative permeability ($\mu \leq 10$) and negative permittivity ($\in \leq 0$). In this case, the radiation line 130 is bent to form a slot 131 for exposing a predetermined width of the substrate body 110 through both ends thereof. Here, the radiation line 130 may be provided to have a loop form, for example, a '⊏' shape. Further, the radiation line 130 is implemented by a zero-order resonator. In other words, the radiation line 130 resonates at a frequency band where a phase constant of the electromagnetic wave becomes zero. That is, the radiation line 130 resonates at a predetermined frequency band when electric power is fed to transmit and receive an electromagnetic wave of the frequency band. At this time, if a magnetic field is formed at a peripheral area to feed electric power, the radiation line 130 may resonate.

The ground unit 150 is provided for ground in the planar CRLH antenna 100. The ground unit 150 is disposed at a lower side of the substrate body 110. At this time, the ground unit 150 may be formed to cover a peripheral region of the radiation line 130 at the lower side of the substrate body 110. Moreover, the ground unit 150 contacts one end of the radiation line 130 to ground the radiation line 130. The ground unit 150 is spaced apart from the other end of the radiation line 130. In addition, when the radiation line 130 resonates, the ground unit 150 may resonate together with the radiation line 130. Here, the size of the ground unit 150 may change impedance of the planar CRLH antenna 100.

The feeder line 170 feeds electric power in the planar CRLH antenna 100 to the radiation line 130. The feeder line 170 is disposed at an upper side of the substrate body 110. In this case, the feeder line 170 may provided by patterning metal materials on a surface of the substrate body 110. Further, the feeder line 170 may be provided by a stick form extending in one direction. Moreover, the feeder line 170 extends on the radiation line 130 across a slot 131. At this time, the feeder line 170 may extend on the other end of the radiation line 130 from the ground unit 150 via the slot 130. Here, the feeder line 170 may overlap with the other end of the radiation line 130. In addition, a voltage may be applied to the feeder line 170 through one end, and be open through the other end on the radiation line 130. At this time, when the electric power is fed, the feeder line 170 may form a magnetic field within a predetermined distance, namely, at a peripheral region of the slot 131.

That is, when the electric power is fed, the feeder line 170 forms a magnetic field to achieve magnetic coupling between the radiation line 130 and the feeder line 170. In other words, the radiation line 130 and the feeder line 170 become an excited state. Through this, electric power is fed from the feeder line 170 to the radiation line 130. When the electric power is fed, the radiation line 130 resonates at a predetermined frequency band together with the ground unit 150.

At this time, a frequency band to be resonated in the planar CRLH antenna 110 is determined based on unique inductance or capacitance. That is, the planar CRLH antenna 100 may have electric characteristics analogous to an equivalent circuit as shown in FIG. 3. In this case, the equivalent circuit of the planar CRLH antenna 100 is composed of a series capacitor $C_1$ and a parallel inductor $L_1$. Here, inductance of the radiation line 130 like that of the parallel inductor $L_1$ is determined according to the size, namely, the length or width of the radiation line 130. In the meantime, capacitance of the radiation line 130 like that of the series capacitor $C_1$ is determined according to the length between the radiation line 130 and the feeder line 170, for example, a thickness of the substrate body 110, the size of an overlapping area, namely, the length or the width between the radiation line 130 and the feeder line 170.

For example, in the planar CRLH antenna 100, an area (pcb_l×pcb_w) may be 40 mm×40 mm, and a height (h) may be 0.8 mm. Further, the area (L×W) of the radiation line 130 is 10 mm×10 mm, which may have the electric size of (0.07λ×0.07λ) at 2 GHz. In the planar CRLH antenna 100, entire parameters may be as follows: W=10 mm, L=10 mm, a=3.5 mm, b=5.5 mm, c=9 mm, d=3 mm, x=3.5 mm, $x_1$=1 mm, $m_1$=2.5 mm, $w_1$=1.54 mm, $w_2$=1 mm, pcb_l=40 mm, pcb_w=40 mm, h=0.8 mm.

Figure 4:
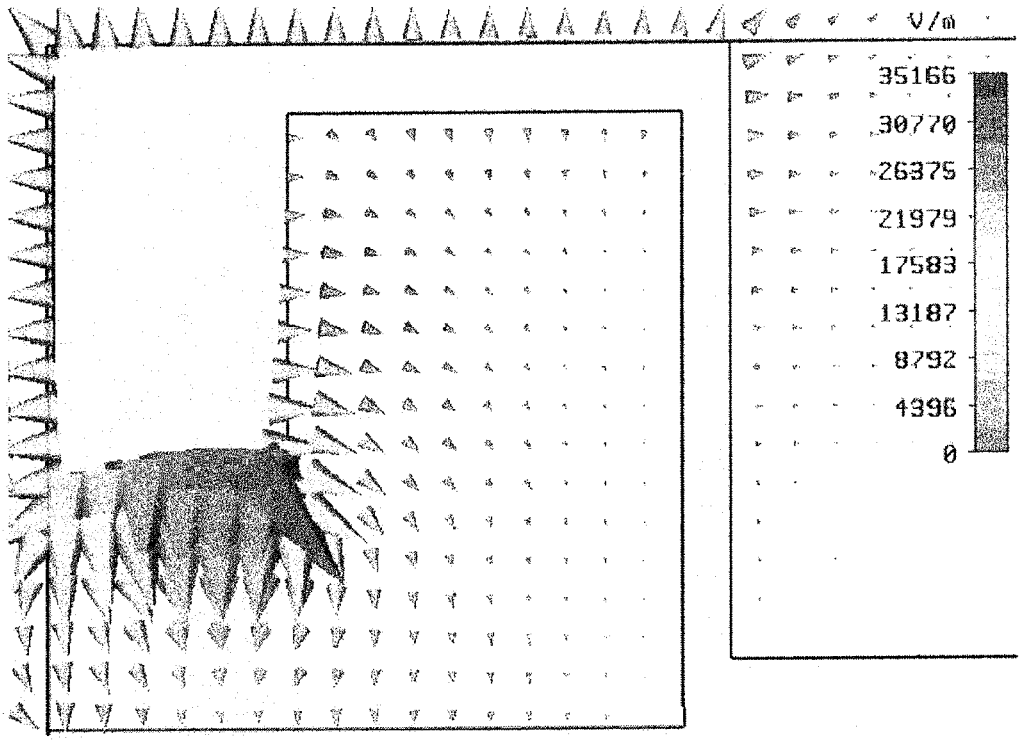
FIG. 4 is a view illustrating the electric field and current distributions upon operation of FIG. 1.
Figure 4:
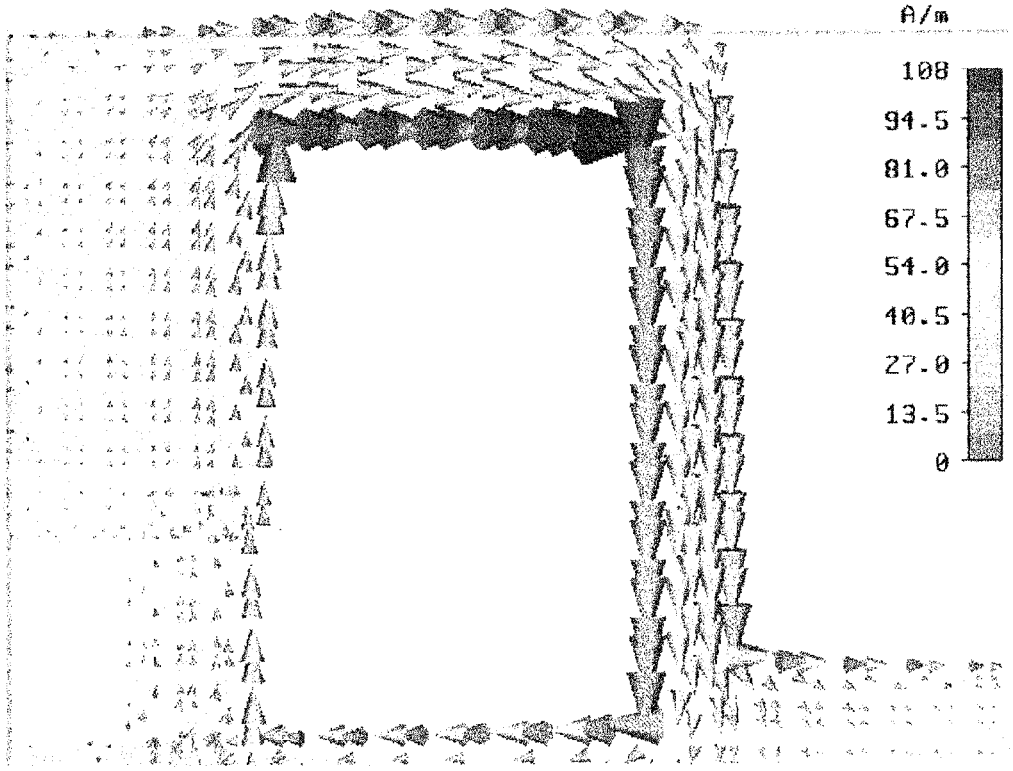
Figure 5:
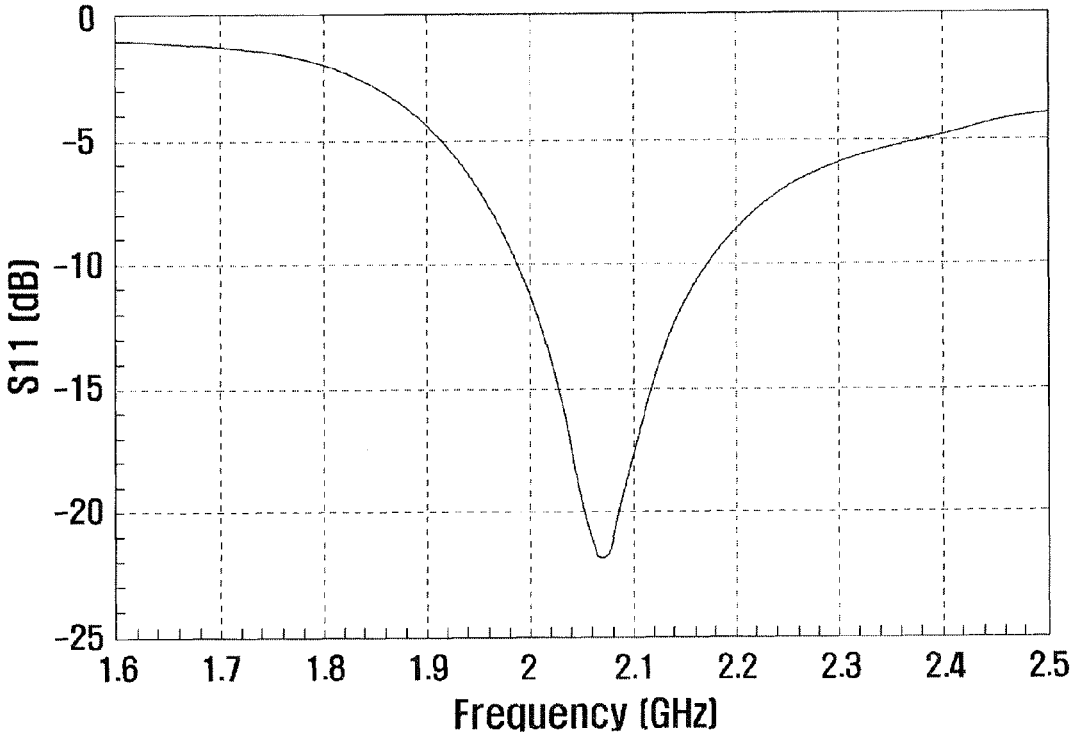
FIG. 5 is a graph illustrating change in an S parameter upon operation of FIG. 1.
Figure 6:
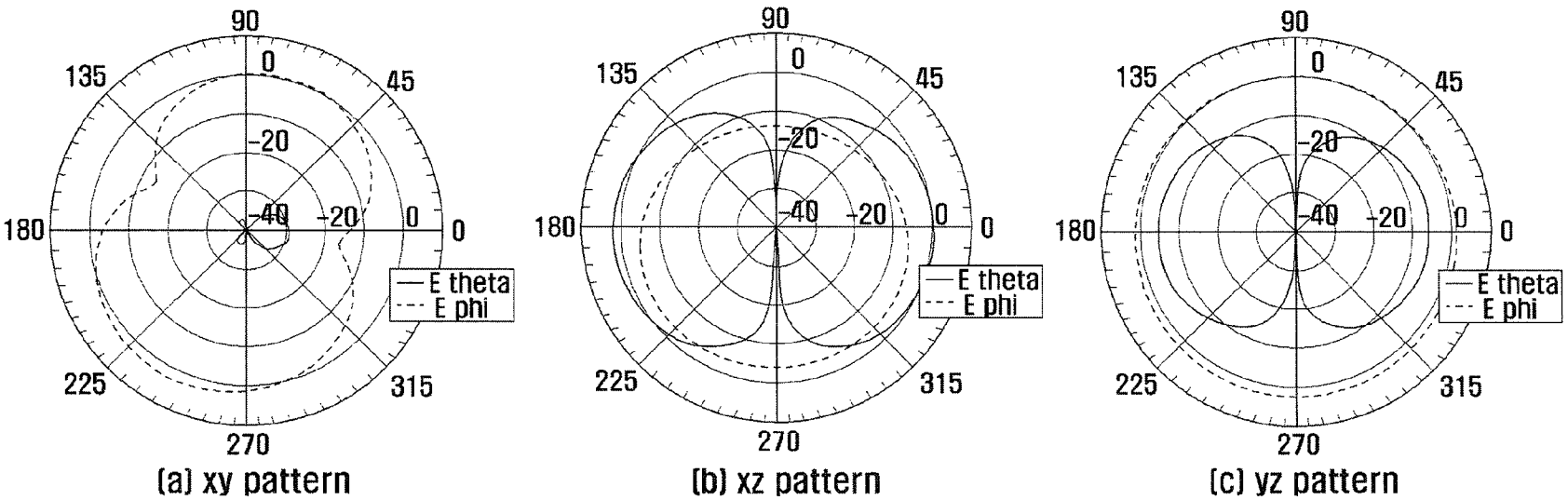
FIG. 6 is a view illustrating a radiation pattern upon operation of FIG. 6.
Figure 7:
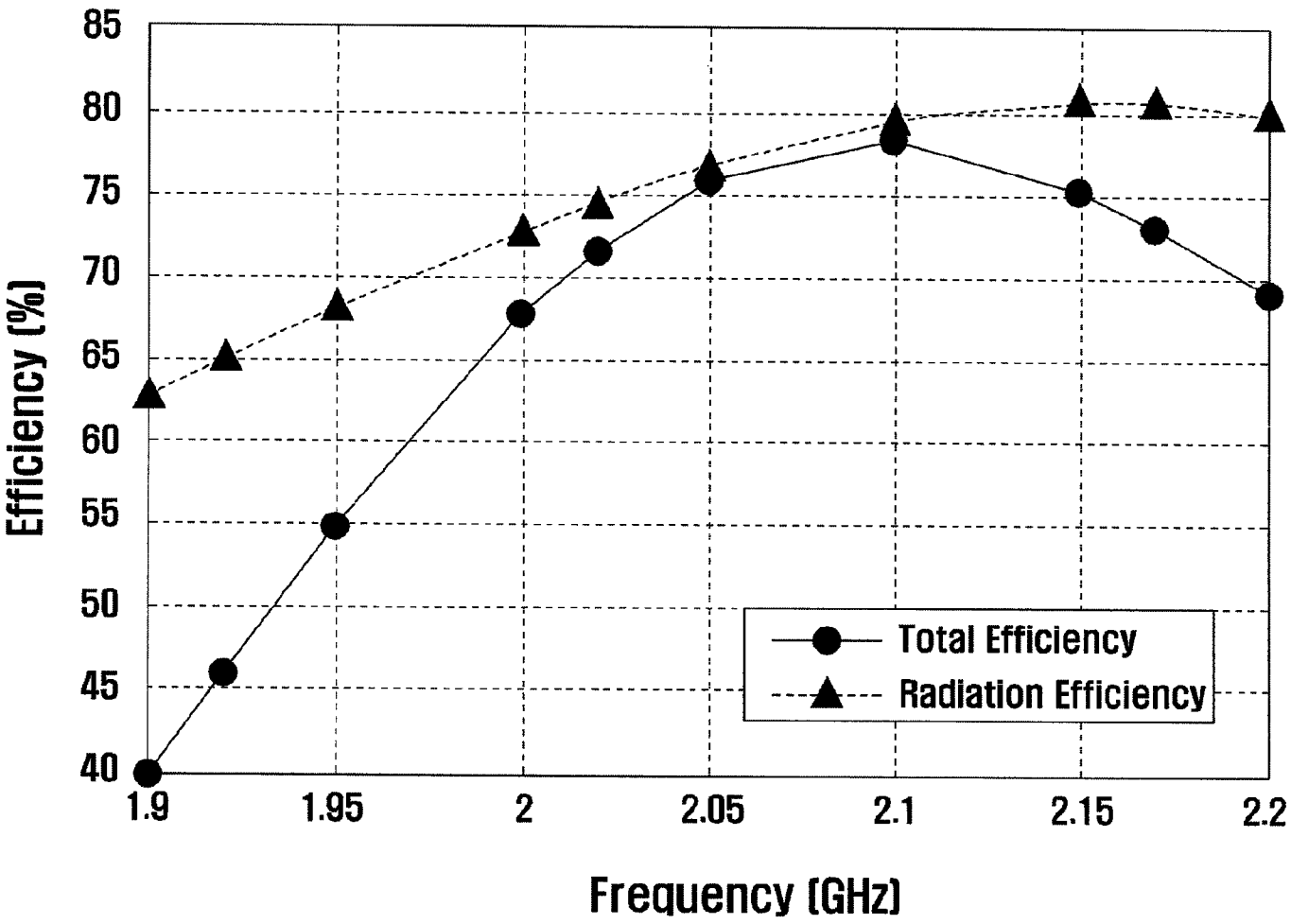
FIG. 7 is a graph illustrating operation efficiency upon operation of FIG. 1.

The following is electric characteristics of the planar CRLH antenna 110. FIG. 4 is a view illustrating the electric field and current distributions upon operation of FIG. 1. FIG. 5 is a graph illustrating change in an S parameter upon operation of FIG. 1. FIG. 6 is a view illustrating a radiation pattern upon operation of FIG. 6. FIG. 7 is a graph illustrating operation efficiency upon operation of FIG. 1.

That is, when a voltage from a source is applied to the planar CRLH antenna 100, an electric current flows to the radiation line 130 through the feeder line 170 as shown in FIG. 4. At this time, a magnetic field is strongly formed in the slot 131 as shown in FIG. 4(*a*). Further, electric current flows through the radiation line 130 and the ground unit 150 as shown in FIG. 4(*b*). Resonation is achieved in the planar CRLH antenna 100 by mutual action of magnetic energy of the slot 131 and magnetic energy of the radiation line 130. At this time, because the planar CRLH antenna 100 is small in size, the ground unit 150 operates as a radiator together with the radiation line 130, and impedance of the planar CRLH antenna 100 may change according to the size of the ground unit 150.

In addition, the planar CRLH antenna 100 resonates at a predetermined frequency band as shown in FIG. 5. At this time, when determining change in an S parameter based on −10 dB, the planar CRLH antenna 100 may resonate at the range of approximately 1.98 GHz 2.17 GHz. Here, a frequency bandwidth to be resonated at the planar CRLH antenna 100 is approximately 190 MHz, which is 9.2% of an entire band. Further, the planar CRLH antenna 100 operates in a radiation pattern as shown in FIG. 6. Total operation efficiency of the planar CRLH antenna 100 is in the range of 46%~78% of a WCDMA band at approximately 1.92 GHz~2.17 GHz as shown in FIG. 7. Here, the total operation efficiency may be determined by applying various losses, for conductance loss, substrate loss, and S11 mismatch to substantial radiation efficiency of the planar CRLH antenna 100.

Figure 8:
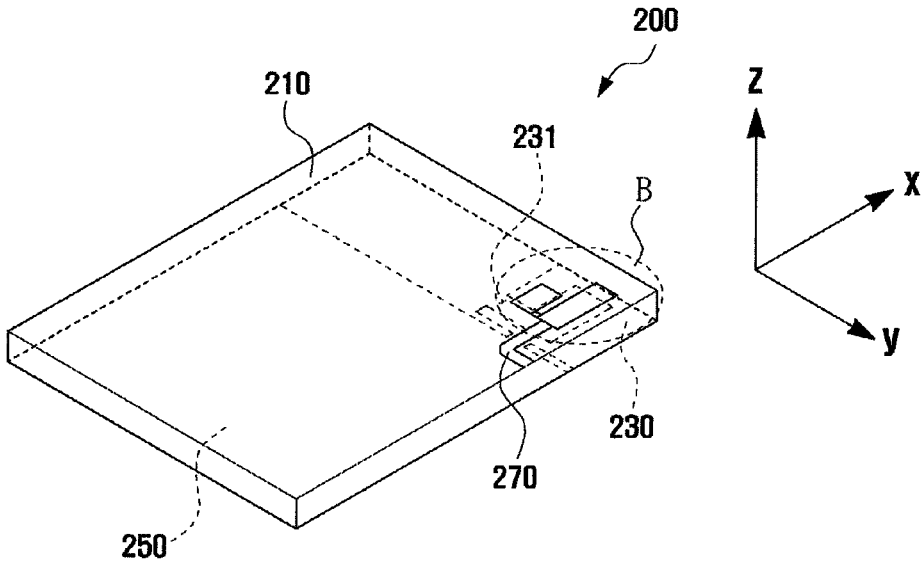
FIG. 8 is a view illustrating a structure of a planar CRLH antenna according to a second embodiment of the present invention.
Figure 8:
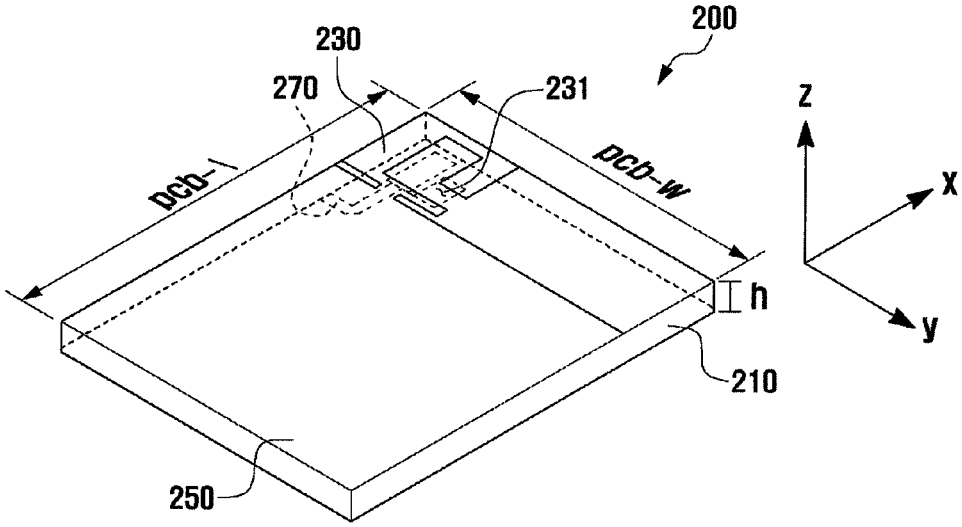
Figure 9:
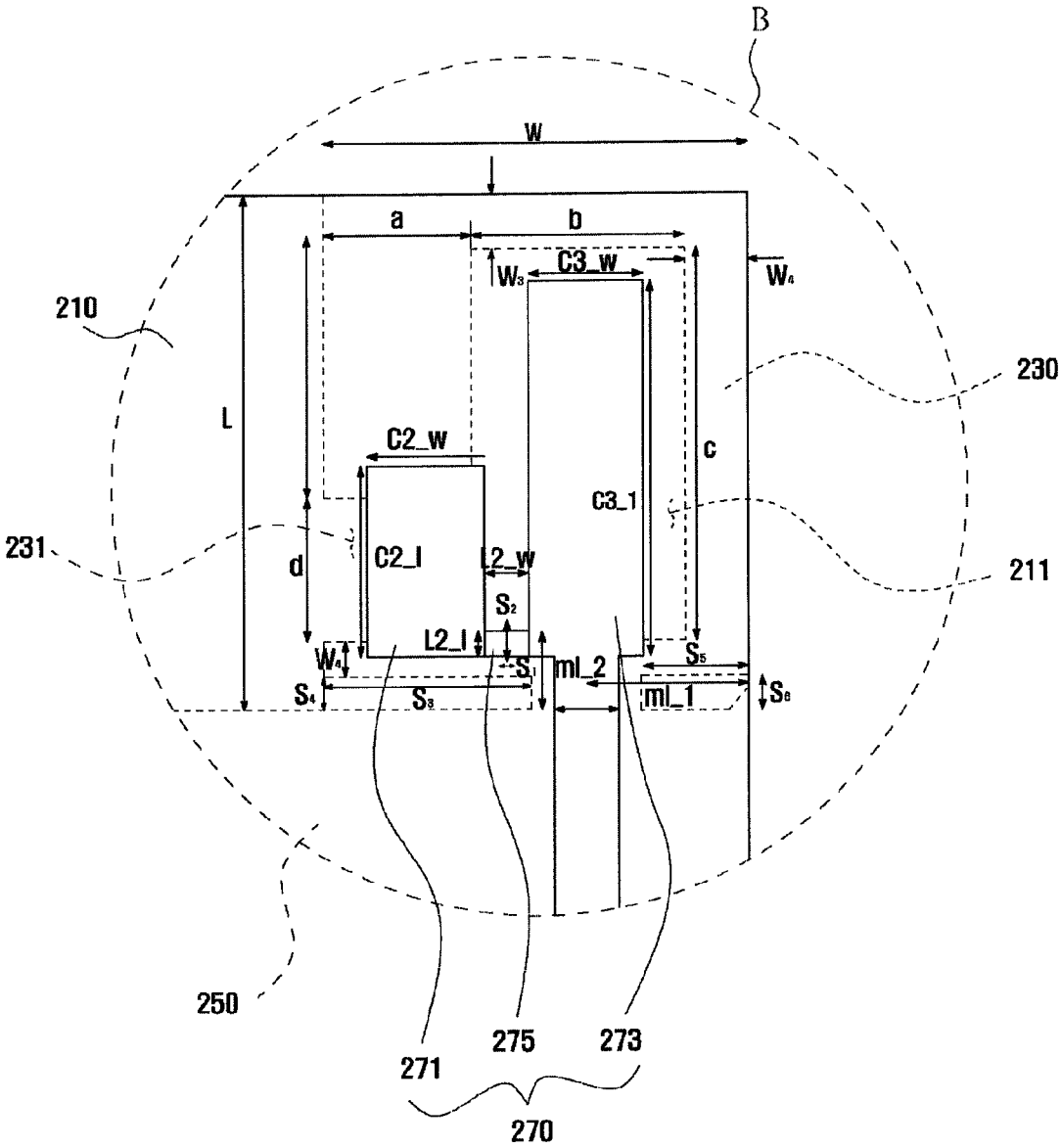
FIG. 9 is an enlarged view illustrating an area 'B' shown in FIG. 8.
Figure 10:
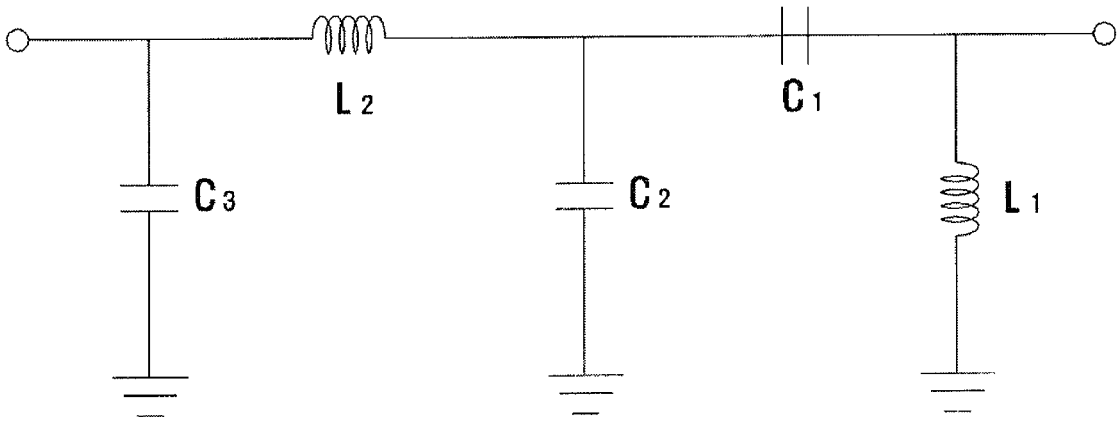
FIG. 10 is a circuitry diagram illustrating an equivalent circuit of FIG. 8.

FIG. 8 is a view illustrating a structure of a planar CRLH antenna according to a second embodiment of the present invention. FIG. 8(*a*) is a perspective plan view of the planar CRLH antenna, and FIG. 8(*b*) is a perspective rear view of the planar CRLH antenna. FIG. 9 is an enlarged view illustrating an area 'B' shown in FIG. 8. FIG. 10 is a circuitry diagram illustrating an equivalent circuit of FIG. 8. At this time, it is assumed in this embodiment that the planar CRLH antenna is implemented by a PCB.

Referring to FIG. 8 and FIG. 9, a planar CRLH antenna 200 according to an embodiment of the present invention, namely, CRLH-slot antenna includes a substrate body 210, a radiation line 230, a ground unit 250, and a feeder line 270.

The substrate body 210 functions as a support in the planar CRLH antenna 200. The substrate body 210 has a planar structure. Further, the substrate body 210 is made of dielectric materials.

The radiation line 230 functions to substantially transmit and receive an electromagnetic wave in the planar CRLH antenna 200. The radiation line 230 is disposed at a lower side of the substrate body 210. In this case, the radiation line 230 may be formed on a surface of the substrate body 210 through patterning metal materials having magnetism. Moreover, the radiation line 230 consists of a Left-Handed Transmission Line (LH-TL) of an LH structure having negative permeability and negative permittivity. In this case, the radiation line 230 is bent to form a slot 231 for exposing a predetermined width of the substrate body 210 through both ends thereof. Here, the radiation line 230 may be provided to have a loop form, for example, a '⊏' shape. Further, the radiation line 230 is implemented by a zero-order resonator. In other words, the radiation line 230 resonates at a frequency band where a phase constant of the electromagnetic wave becomes zero. That is, the radiation line 230 resonates at a predetermined frequency band when electric power is fed to transmit and receive an electromagnetic wave of the frequency band. At this time, if a magnetic field is formed at a peripheral area to feed electric power, the radiation line 230 may resonate.

The ground unit 250 is provided for ground in the planar CRLH antenna 200. The ground unit 250 is disposed at a lower side of the substrate body 210. At this time, the ground unit 150 may be formed to cover a peripheral region of the radiation line 230 at the lower side of the substrate body 110. Moreover, the ground unit 250 contacts one end of the radiation line 230 to ground the radiation line 130. The ground unit 250 is spaced apart from the other end of the radiation line 230. In addition, when the radiation line 230 resonates, the ground unit 250 may resonate together with the radiation line 230. Here, the size of the ground unit 250 may change impedance of the planar CRLH antenna 200.

The feeder line 270 feeds electric power in the planar CRLH antenna 200 to the radiation line 230. The feeder line 270 is disposed at an upper side of the substrate body 210. In this case, the feeder line 270 may provided by patterning metal materials on a surface of the substrate body 210. Further, the feeder line 170 is configured by a Right-Handed Transmission Line (RH-TL). Here, the feeder line 170 may be configured by one of a meander type, a spiral type, a step type, or a loop type, for example, a '⊏' shape, a 'C' shape, or a '⊐' shape. Moreover, when electric power is fed, the feeder line 270 may resonate at a predetermined frequency band to transmit and receive an electromagnetic wave of a corresponding frequency band. At this time, the feeder line 270 may resonate at a frequency band similar to that of the radiation line 230. Meanwhile, the feeder line 270 may resonate at a frequency band different from that of the radiation line 230. In addition, a voltage may be applied to the feeder line 270 through one end, and be open through the other end on the radiation line 230. At this time, when the electric power is fed, the feeder line 270 may form a magnetic field at a peripheral region within a predetermined distance.

The feeder line 270 includes a resonation line 271 and a matching line 273. The resonation line 271 transmits and receives an electromagnetic wave. The resonation line extends on the radiation line 230 across a slot 231. At this time, the resonation line 271 may overlap with the radiation line 230 at both ends thereof. The matching line 273 is provided in the radiation line 230 to acquire impedance matching with a predetermined level. As the radiation line 230 is bent from the substrate body 210, the matching line 273 extends to a device open region 211 exposed from the radiation line 230. Here, the device open area 211 connects with the slot 231. In this case, the matching line 273 may extend via the radiation line 230 to overlay with the radiation line 230. Further, the matching line 273 substantially feeds electric power to the radiation line 230 and the resonation line 271. Here, the resonation line 271 and the matching line 273 may extend in a line. Moreover, the resonation line 271 and the matching line 273 may connect with each other.

In addition, the feeder line 270 may further include a connection line 275. The connection line 275 transmits and receives an electromagnet wave to and from the resonation line 271. The connection line 275 connects the matching line 273 to the resonation line 271. At this time, the connection line 275 is configured by a transmission line made of metal materials. At this time, the electric power from the matching line 273 is fed to the resonation line 271 through the connection line 271, and then fed to the radiation line 230. Further, the feeder line 270 having the connection line 275 may resonate at a frequency band similar to that of the radiation line 230. Through this, the planar CRLH antenna 200 may resonate at an expanded single frequency band.

That is, when the electric power is fed, the feeder line 270 forms a magnetic field to achieve magnetic coupling between the radiation line 230 and the feeder line 270. In other words, the radiation line 230 and the feeder line 270 become an excited state. Through this, electric power is fed from the feeder line 270 to the radiation line 230. When the electric power is fed, the radiation line 230 resonates at a predetermined frequency band together with the ground unit 250, and the feeder line 270 resonates at another frequency band.

At this time, a frequency band for resonation at the planar CRLH antenna 200 is determined according to unique inductance or capacitance. That is the planar CRLH antenna 200 may have electric characteristics similar to those of an equivalent circuit as shown in FIG. 10. In this case, the equivalent circuit of the planar CRLH antenna 200 is composed of a series capacitor $C_1$ and a parallel inductor $L_1$, a series inductor $L_1$, and parallel capacitors $C_1$ and $C_2$.

Here, inductance of the radiation line 230 like that of the parallel inductor $L_1$ is determined according to the size, namely, the length or width of the radiation line 130. Capacitance of the radiation line 230 like a series capacitor $C_1$ is according to a distance between one end of the radiation line 230 and the feeder line 270, for example, a thickness of the substrate body 210, or the size, namely, the length or width of an overlapping area between the radiation line 230 and the feeder line 270. Inductance of the feeder line 270 like that of a series inductor $L_2$ is determined according to the size, namely, the length or width of the feeder line 270, in particular, the connection line 275. Furthermore, capacitance of the feeder line 270 like that of a parallel capacitor $C_2$ is determined according to a distance between another end of the radiation line 230 and the feeder line 270, for example, a thickness of the substrate body 210, or the size, namely, the length or width of an overlapping area between the radiation line 230 and the feeder line 270. Impedance for implementing impedance matching of the radiation line 230 as well as capacitance of the feeder line 270 like that of a parallel capacitor $C_3$ are determined according to the size, namely, the length or width of the matching line 273 in the feeder line 270.

For example, in the planar CRLH antenna 200, an area (pcb_l×pcb_w) may be 40 mm×40 mm, and a height (h) may be 0.8 mm. Further, the area (L×W) of the radiation line 230 and the feeder liner 270 is 10 mm×10 mm, which may have the electric size of (0.07λ×0.07λ) at 2 GHz. In the planar CRLH antenna 100, entire parameters may be as follows: W=10 mm, L=12 mm, a=3.5 mm, b=5 mm, c=8.7 mm, d=3 mm, $w_1$=1.54 mm, $w_2$=1.2 mm, $w_3$=1.3 mm, $w_4$=1.5 mm, $s_1$=0.5 mm, $s_2$=0.7 mm, $s_3$=4.9 mm, $s_4$=0.8 mm, $s_5$=2.5 mm, $s_6$=0.8 mm, C3_l=9.7 mm, C3_w=2.7 mm, C2_=4.2 mm, C2_w=2.7 mm, L2_l=0.5 mm, L2_w=1 mm, ml_1=3.8 mm, ml_2=1.65 mm, pcb_l=40 mm, pcb_w=40 mm, h=0.8 mm.

That is, when the connection line 275 connects the matching line 273 to the resonation line 271, main resonation of a predetermined frequency band is performed at the radiation line 230. Additional resonation of another frequency band similar to the predetermined frequency band in the feeder line 270 is performed with the radiation line 230. Owing to this, a planar CRLH antenna 200 of the present invention may resonate at a frequency band expanded than a frequency band for resonation at the radiation line 230. In addition, impedance matching performance at the planar CRLH antenna 200 may be enhanced by the matching line 273 of the feeder line 270.

Figure 11:
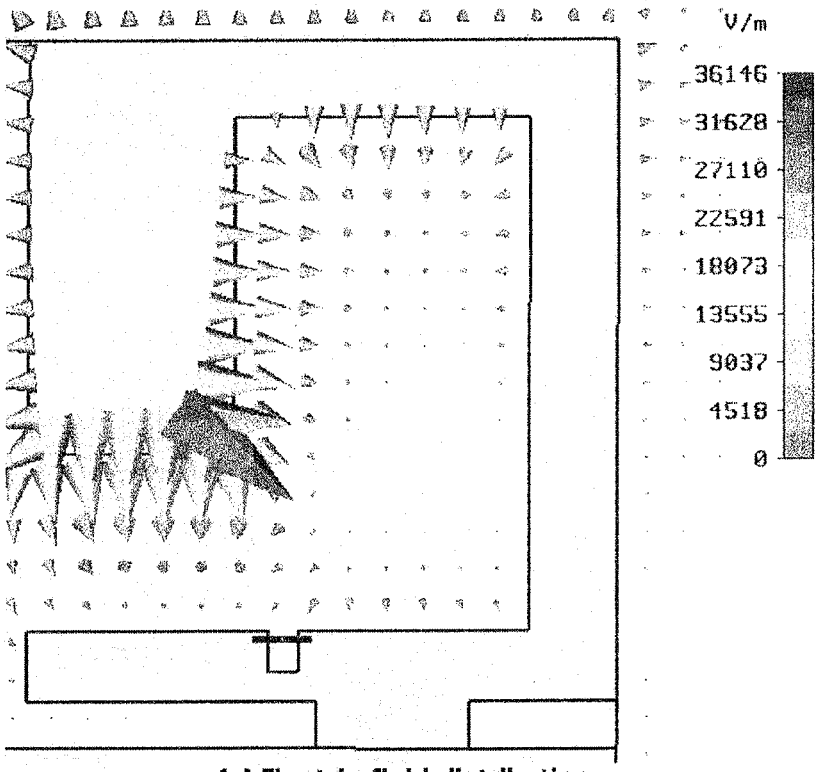
FIG. 11 is a view illustrating the electric field and current distributions upon first frequency mode operation of FIG. 8.
Figure 11:
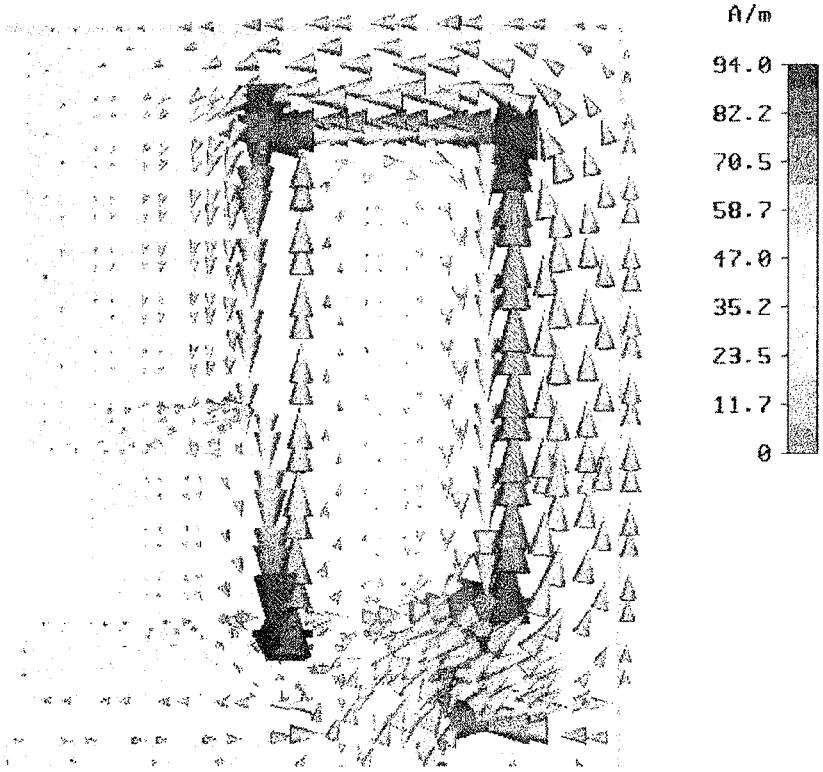
Figure 12:
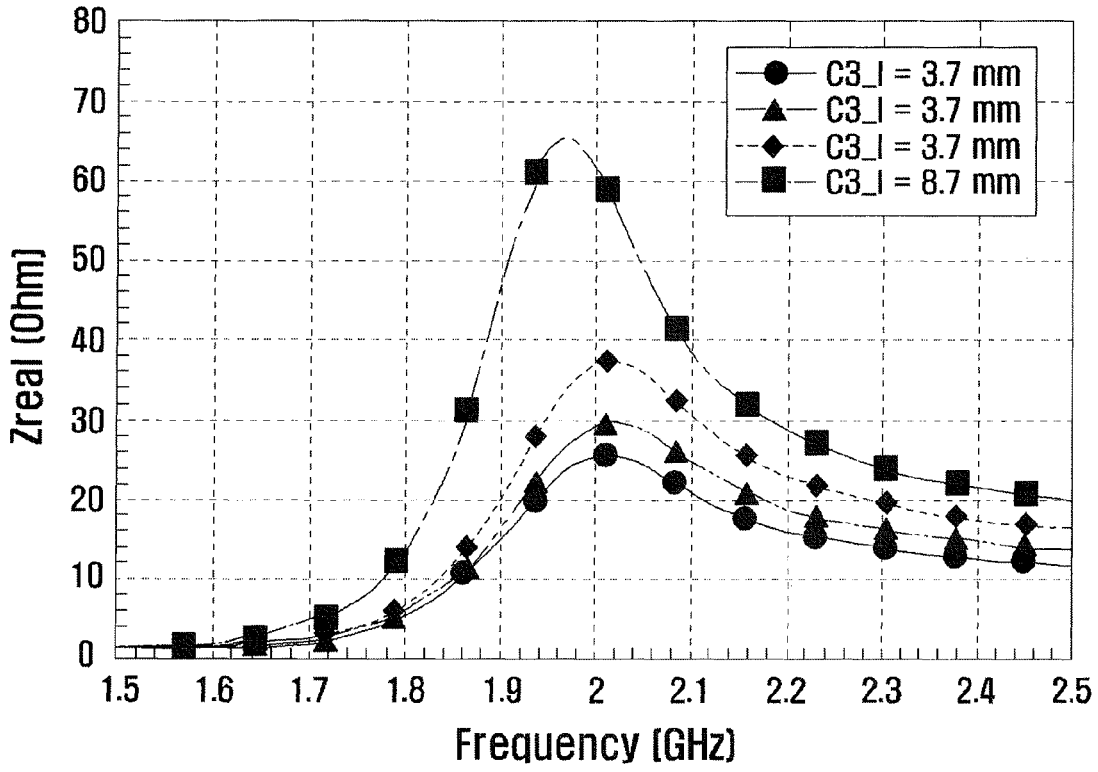
FIG. 12 is a view illustrating change in a Zreal upon first frequency mode operation of FIG. 8.
Figure 13:
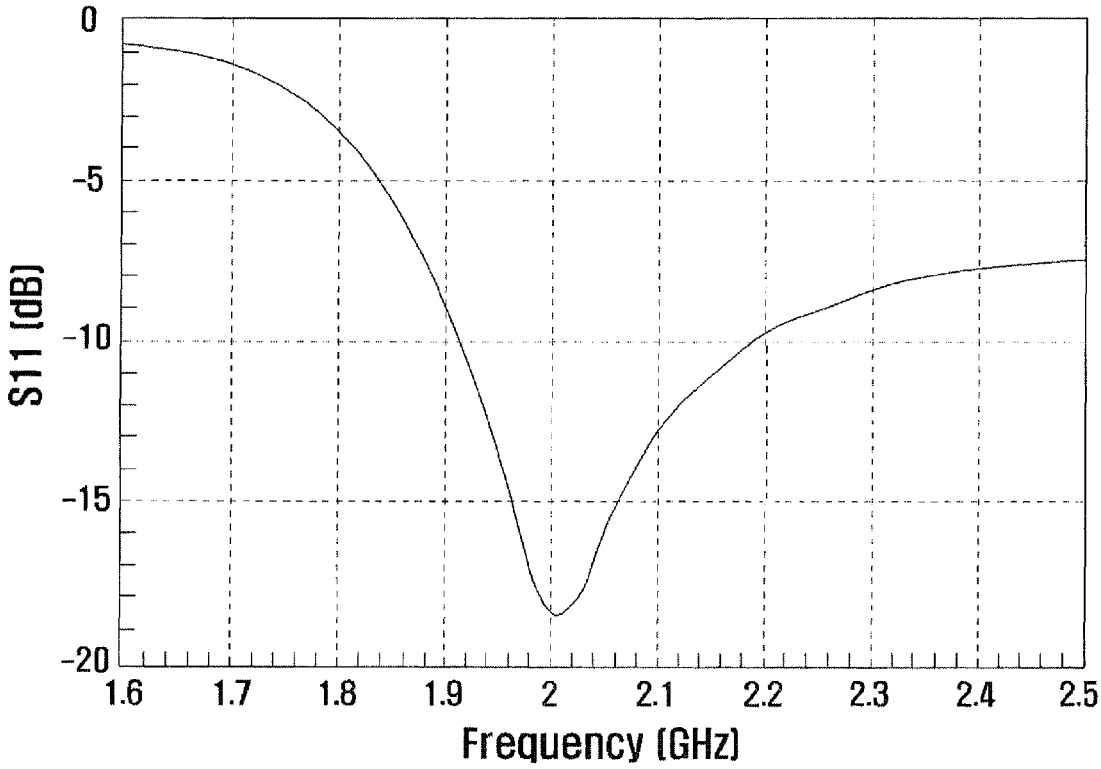
FIG. 13 is a view illustrating change in an S parameter upon first frequency mode operation of FIG. 8.
Figure 14:
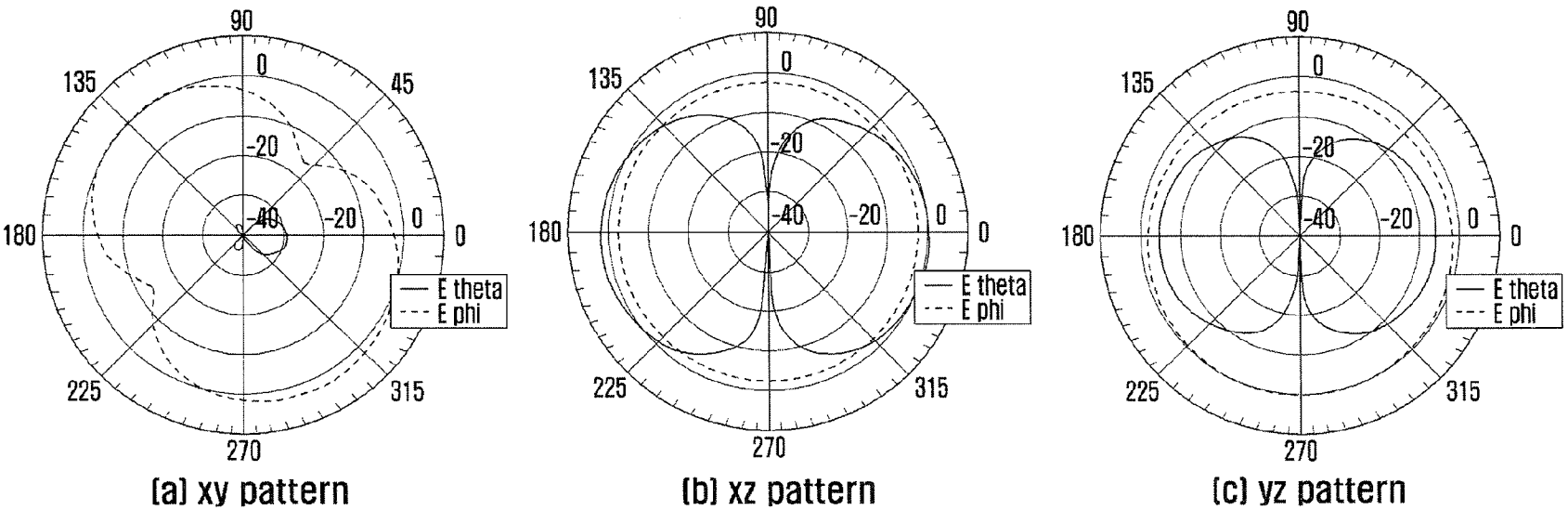
FIG. 14 is a view illustrating a radiation pattern upon first frequency mode operation of FIG. 8.
Figure 15:
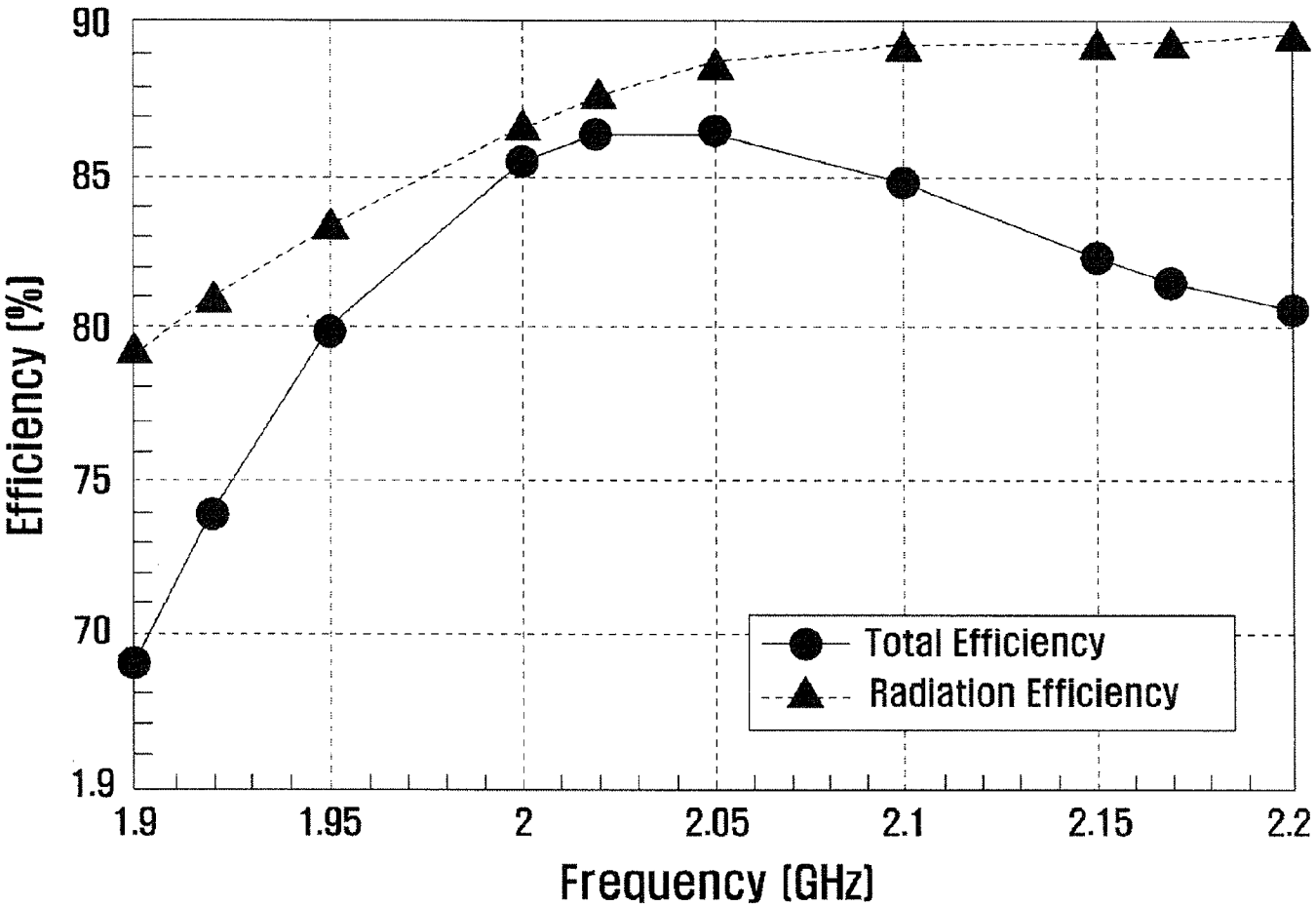
FIG. 15 is a view illustrating operation efficiency upon first frequency mode operation of FIG. 8.

The following is electric characteristics of the planar CRLH antenna 200. FIG. 11 is a view illustrating an electric field distribution and a current distribution upon first frequency mode operation of FIG. 8. FIG. 12 is a view illustrating change in a Zreal upon first frequency mode operation of FIG. 8. FIG. 13 is a view illustrating an S parameter upon first frequency mode operation of FIG. 8. FIG. 14 is a view illustrating a radiation pattern upon first frequency mode operation of FIG. 8. FIG. 15 is a view illustrating operation efficiency upon first frequency mode operation of FIG. 8. At this time, the first frequency mode indicates an operation state where the planar CRLH antenna 200 resonates at a single frequency band.

That is, when a voltage from a source is applied to the planar CRLH antenna 200, an electric current flows to the radiation line 230 through the feeder line 270 as shown in FIG. 11. In other words, in the planar CRLH antenna 200, an electric field is distributed as shown in FIG. 11(*a*), and electric current flows as shown in FIG. 11(*b*). Resonation is achieved in the planar CRLH antenna 200 by mutual action of magnetic energy of the slot 231 and magnetic energy of the radiation line 230 and the feeder line 270. At this time, because the planar CRLH antenna 200 is small in size, the ground unit 250 operates as a radiator together with the radiation line 230, and impedance of the planar CRLH antenna 200 may change according to the size of the ground unit 250 and the size of the matching line 273. For example, FIG. 12 shows Zreal according to the length C31 of the matching line 273. That is, if the length of the matching line 273 is increased, the Zreal is increased. If the length of the matching line 273 is reduced, the Zreal is reduced. In other words, efficient impedance matching is achieved when the Zreal is in the range of 60Ω~70Ω. This may be implemented according to the length of the matching line 273.

In addition, the planar CRLH antenna 200 resonates at a predetermined frequency band as shown in FIG. 13. At this time, when determining change in an S parameter based on −10 dB, the planar CRLH antenna 200 may resonate in the range of approximately 1.91 GHz 2.22 GHz. Here, a frequency bandwidth to be resonated at the planar CRLH antenna 200 is approximately 310 MHz, which is 15% of an entire band. Further, the planar CRLH antenna 200 operates in a radiation pattern as shown in FIG. 14. Total operation efficiency of the planar CRLH antenna 200 is in the range of 74%~86% of a WCDMA band at 2 GHz as shown in FIG. 15. Here, the total operation efficiency may be determined by applying various losses, for conductance loss, substrate loss, and S11 mismatch to substantial radiation efficiency of the planar CRLH antenna 200.

Meanwhile, this embodiment has illustrated that the resonation line 271 and the matching line 273 are connected with each other by the connection line 274 by way of example. The present invention is not limited thereto. That is, the connection line 275 may be substituted by an inductor (not shown) having preset inductance. In other words, the resonation line 271 and the matching line 273 may connect with each other by an inductor. At this time, electric power from the matching line 273 is fed to the resonation line 271 through the inductor and then fed to the radiation line 230. Further, the feeder line 270 having the inductor may resonate at a frequency band different from that of the radiation line 230. Through this, the planar CRLH antenna 200 may resonate at two frequency bands, namely, a first frequency band and a second frequency band. Here, the radiation line 230 may resonate at a relatively low frequency band, for example, a first frequency band, and the feeder line 270 resonate at a relatively high frequency band, for example, a second frequency band.

That is, when the matching line 273 connects with the resonation line 271, main resonation of a predetermined frequency band is performed at the radiation line 230. Additional resonation of another frequency band similar to the predetermined frequency band in the feeder line 270 is performed with the radiation line 230. Owing to this, a planar CRLH antenna 200 of the present invention may resonate at two frequency bands. In addition, impedance matching performance at the planar CRLH antenna 200 may be enhanced by the matching line 273 of the feeder line 270.

The following is electric characteristics of the planar CRLH antenna 200.

Figure 16:
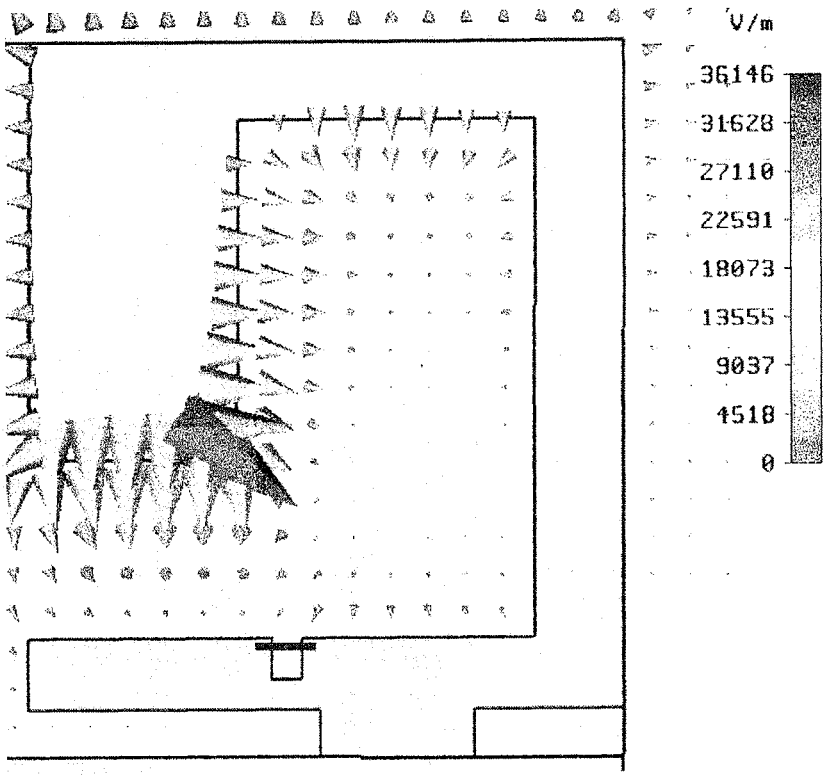
FIG. 16 is a view illustrating the current distribution upon second frequency mode operation of FIG. 8.
Figure 16:
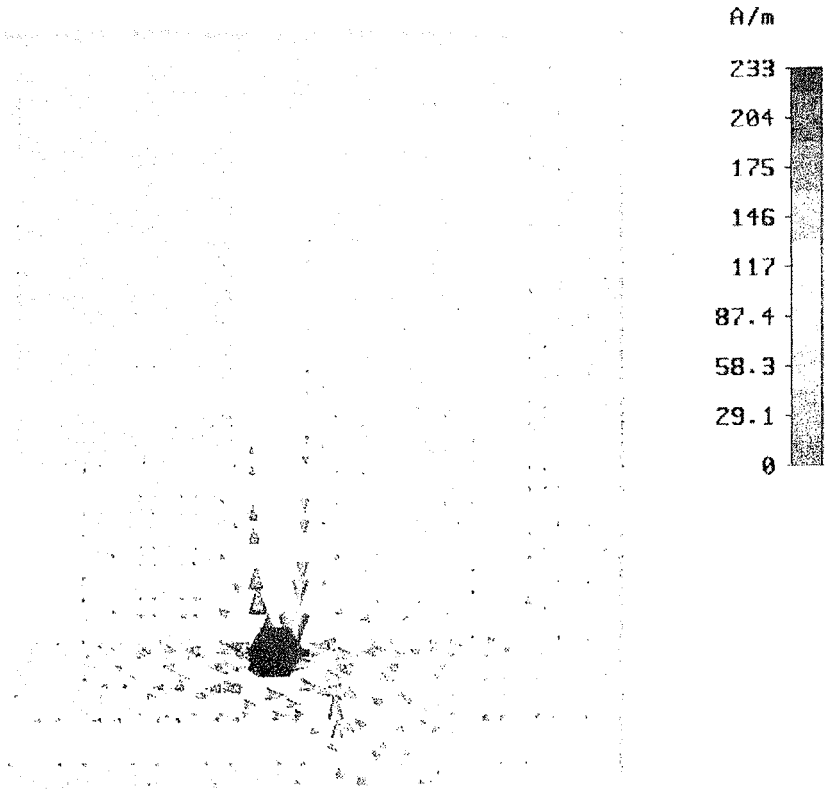
Figure 17:
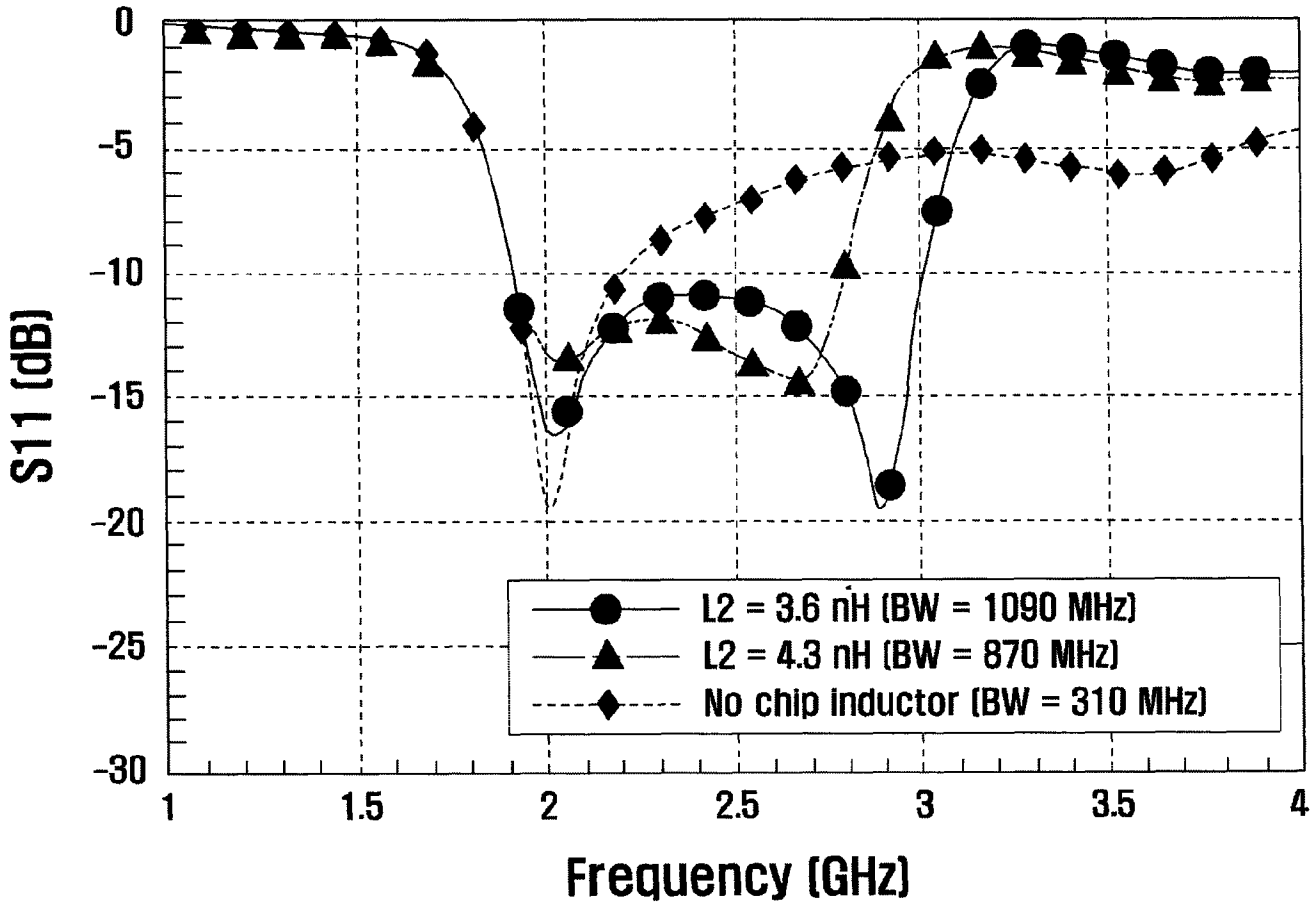
FIG. 17 is a graph illustrating an example of change in an S parameter upon second frequency mode operation of FIG. 8.
Figure 18:
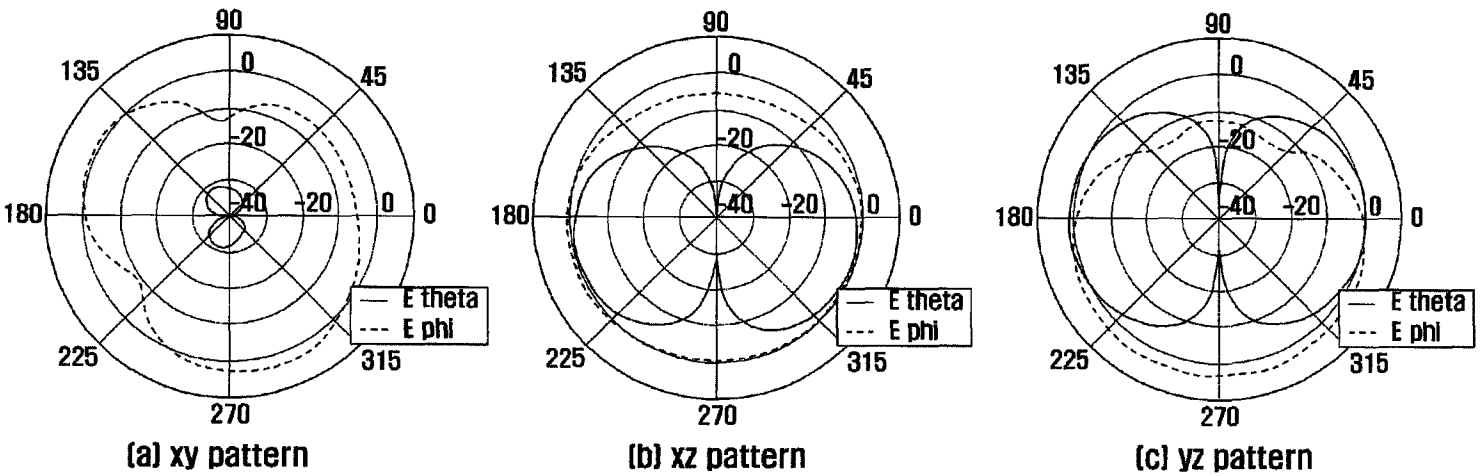
FIG. 18 is a view illustrating a radiation pattern upon second frequency mode operation of FIG. 8.
Figure 19:
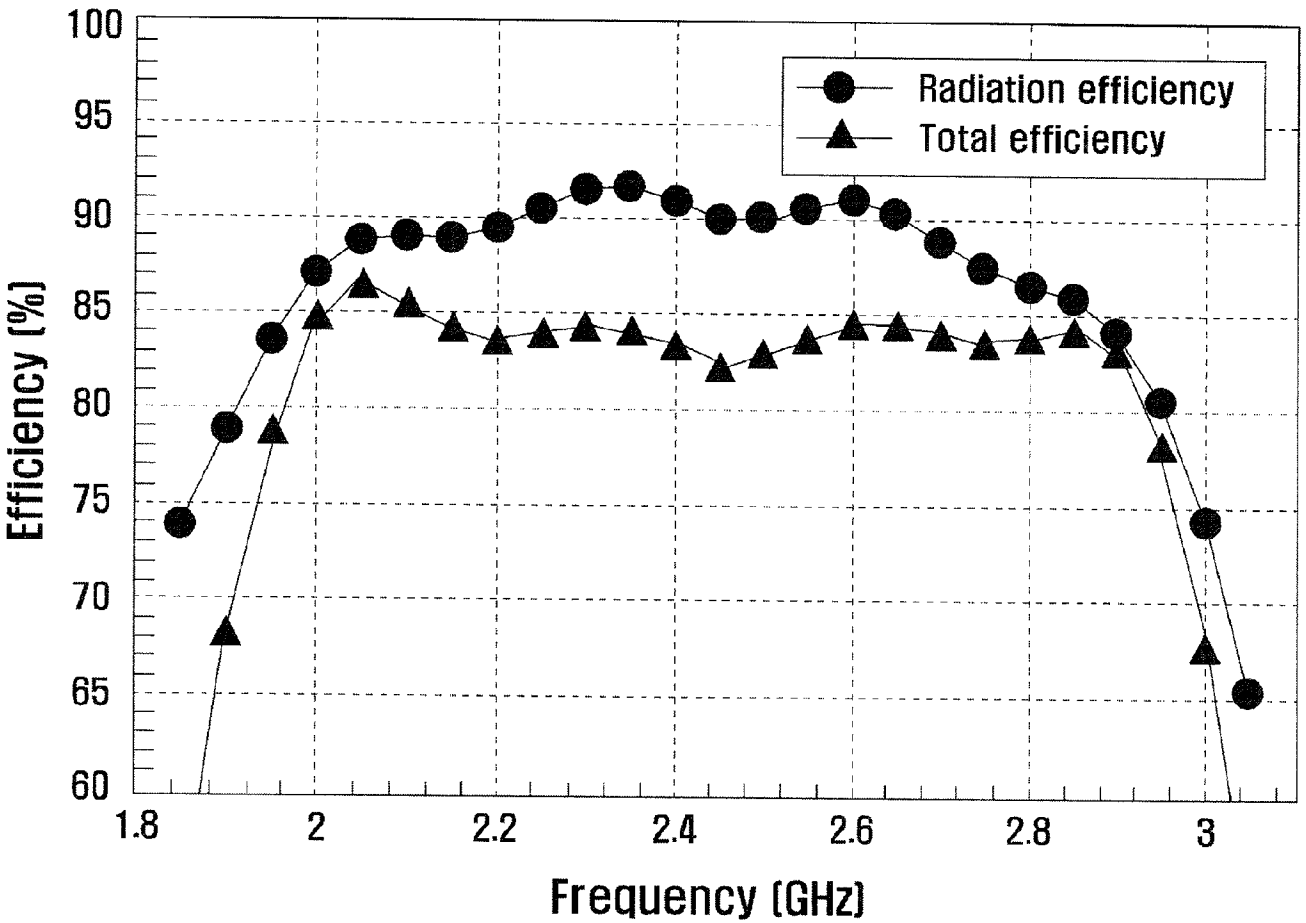
FIG. 19 is a view illustrating operation efficiency upon second frequency mode operation of FIG. 8.

FIG. 16 is a view illustrating a current distribution upon second frequency mode operation of FIG. 8. FIG. 17 is a graph illustrating an example of change in an S parameter upon second frequency mode operation of FIG. 8. FIG. 18 is a view illustrating a radiation pattern upon second frequency mode operation of FIG. 8. FIG. 19 is a view illustrating operation efficiency upon second frequency mode operation of FIG. 8. At this time, the second frequency mode indicates an operation state where the planar CRLH antenna 200 resonates at a dual frequency band.

That is, when a voltage from a source is applied to the planar CRLH antenna 200, an electric current flows to the radiation line 230 through the feeder line 270 as shown in FIG. 16. In other words, in the planar CRLH antenna 200, an electric field is distributed as shown in FIG. 16(*a*) through the radiation line 230, and electric current flows as shown in FIG. 16(*b*) through the feeder line 270.

Further, the planar CRLH antenna 200 resonates at at least one frequency band as shown in FIG. 17. At this time, if the resonation line 271 and the matching line 273 are connected with each other by the connection line 275, the planar CRLH antenna 200 resonates at 2 GHz. Further, the resonation line 271 and the matching line 273 are connected to each other by an inductor, the planar CRLH antenna 200 resonates at 2 GHz and another frequency band spaced apart from 2 GHz. For example, if inductance of the inductor is 3.6 nH, the planar CRLH antenna 200 may resonate at 2 GHz and 2.9 GHz. Meanwhile, if the inductance of the inductor is 4.3 nH, the planar CRLH antenna 200 may resonate at 2 GHz and 2.7 GHz.

Furthermore, if the resonation line 271 and the matching line 273 are connected to each other by the connection line 275, the planar CRLH antenna 200 resonates at 2 GHz of approximately 310 MHz width. If the resonation line 271 and the matching line 273 are connected to each other by an inductor, the planar CRLH antenna 200 resonates at a frequency band of an expanded width. For example, if inductance of the inductor is 3.6 nH, the planar CRLH antenna 200 may resonates at 2 GHz and 2.9 GHz having 1090 MHz width. In the meantime, if inductance of the inductor is 4.3 nH, the planar CRLH antenna 200 may resonate at 2 GHz and 2.7 GHz having approximately 870 MHz.

Moreover, the planar CRLH antenna 200 operates at a second frequency band in a radiation pattern as shown in FIG. 18. Meanwhile, assuming that inductance of an inductor is 3.6 nH, total operation efficiency of the planar CRLH antenna 200 is 68%~86% in the range of 1.9 GHz~3.0 GHz. Here, the total operation efficiency may be determined by applying various losses, for conductance loss, substrate loss, and S11 mismatch to substantial radiation efficiency of the planar CRLH antenna 200.

In the meantime, the foregoing embodiment has illustrated that the planar CRLH antenna 200 uses a dual frequency band by adjusting the length of width of the connection line 275 or adjusting inductance of the feeder line 270 using an inductor. The present invention is not limited thereto. For example, the planar CRLH antenna 200 may use a dual frequency band by adjusting a location of a connection line 275 or an inductor. Meanwhile, the planar CRLH antenna 200 may use a dual frequency band by adjusting capacitance of the feeder line 270.

Figure 20:
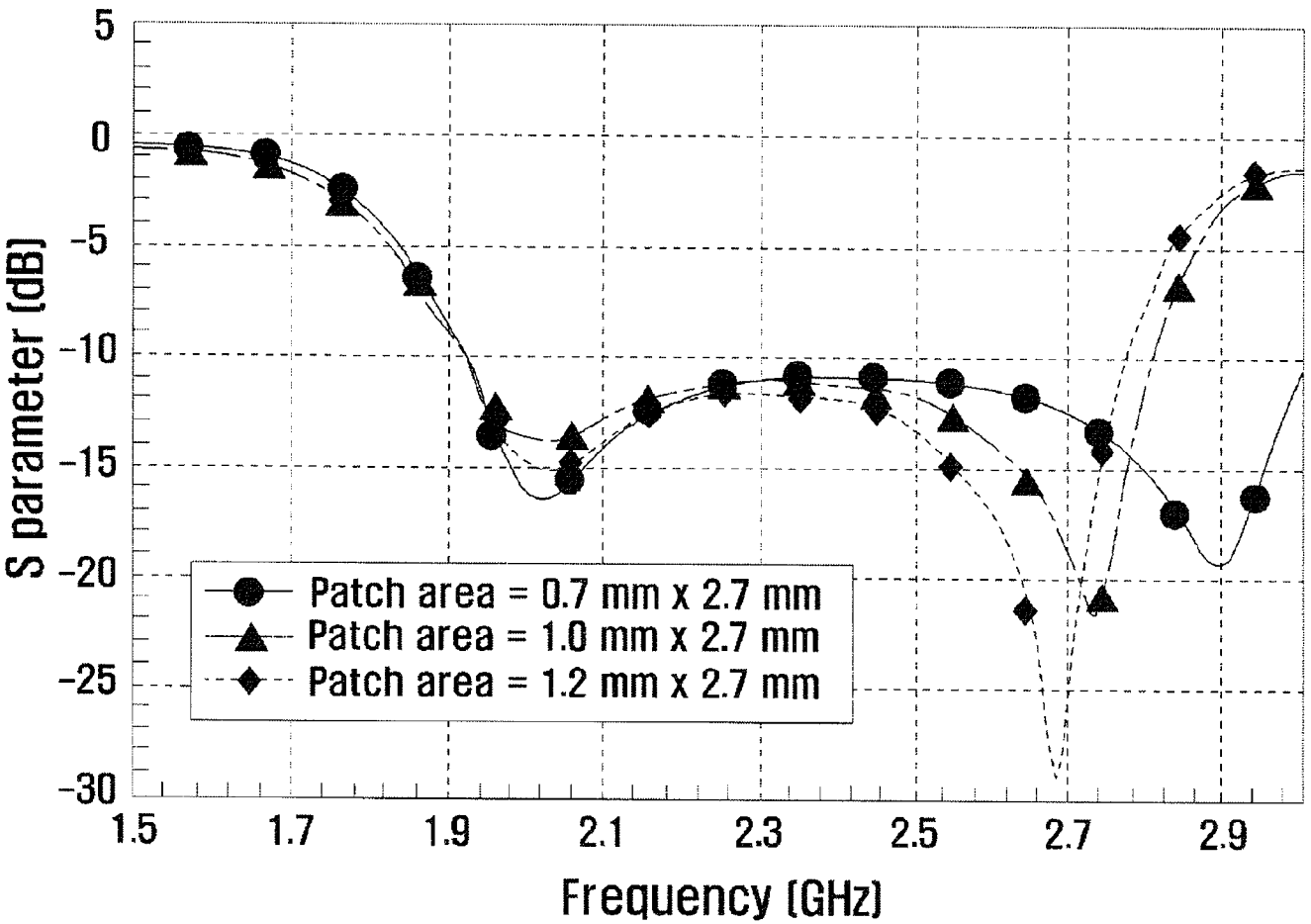
FIG. 20 is a graph illustrating another example of change in an S parameter upon second frequency mode operation of FIG. 8.

The following is a description of electric characteristics of the planar CRLH antenna 200. FIG. 20 is a graph illustrating another example of change in an S parameter upon second frequency mode operation of FIG. 8.

That is, the planar CRLH antenna 200 resonates at at least one frequency band as shown in FIG. 20. At this time, a second frequency band may be determined according to the size of an overlapping area between the radiation line 230 and the resonation line 271. For example, as the overlapping area between the radiation line 230 and the resonation line 271 increases from 0.7 mm×2.7 mm to 1.2 mm×2.7 mm, the second frequency band may be reduced from 2.9 GHz to 2.7 GHz. However, although the overlapping area between the radiation line 230 and the resonation line 271 increases from 0.7 mm×2.7 mm to 1.2 mm×2.7 mm, the first frequency band may maintain.

Meanwhile, this may change a frequency band resonated at the planar CRLH antenna according to the foregoing embodiment by changing the size of the planar CRLH antenna. FIG. 21 to FIG. 25 show examples thereof, and illustrate a third embodiment and a fourth embodiment of the present invention.

Figure 21:
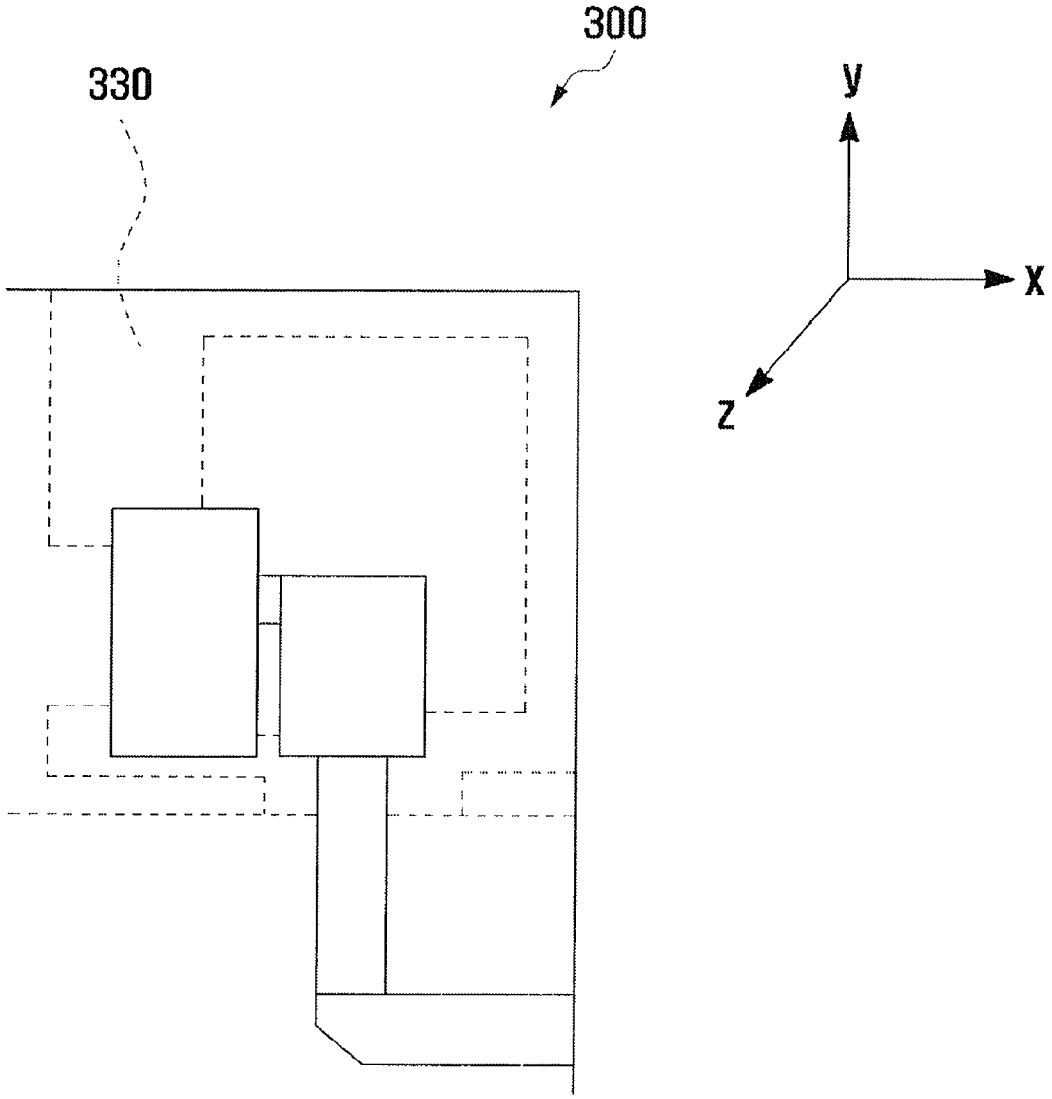
FIG. 21 is a view illustrating a structure of a planar CRLH antenna according to a third embodiment of the present invention.
Figure 22:
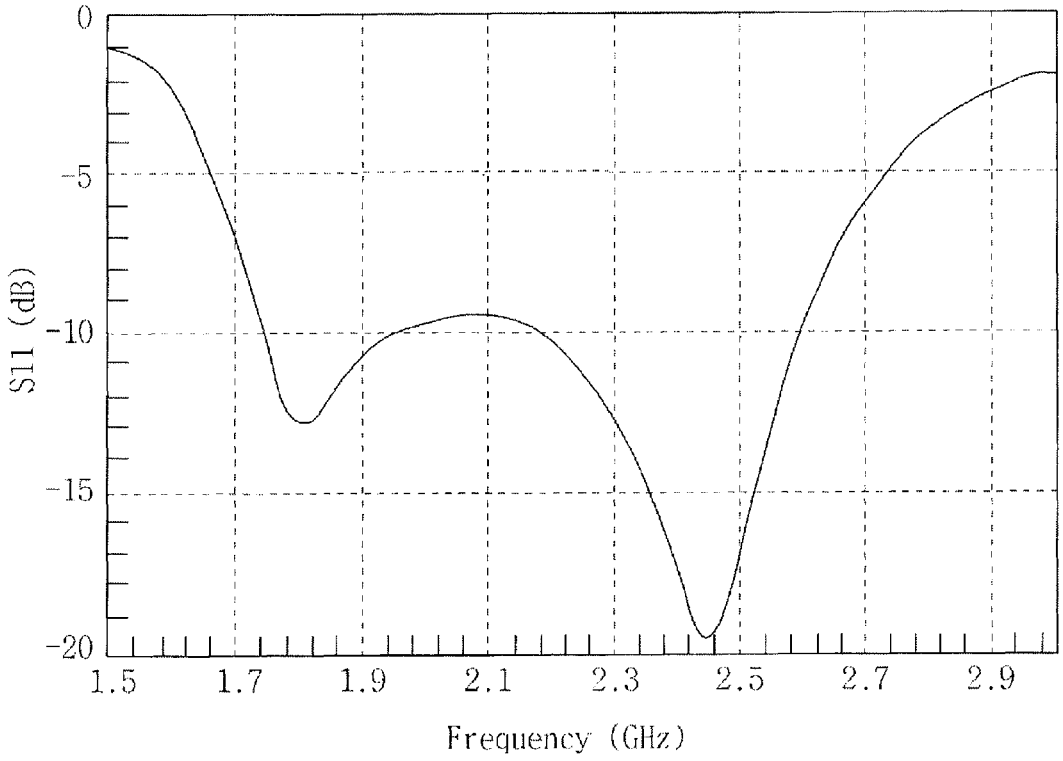
FIG. 22 is a graph illustrating change in an S parameter upon operation of FIG. 21.

FIG. 21 is a view illustrating a structure of a planar CRLH antenna according to a third embodiment of the present invention. FIG. 22 is a graph illustrating change in an S parameter upon operation of FIG. 21

Referring to FIG. 21, the fundamental construction of the planar CRLH antenna 300 is identical to that shown in the foregoing embodiment, and thus a detailed description thereof is omitted. However, the planar CRLH antenna 300 is implemented to have the size of 40 mm×40 mm×0.8 mm, and a radiation line 330 of the planar CRLH antenna 300 is implemented to have the area of 12 mm×12 mm.

That is, when determining change in an S parameter based on −9.4 dB, the planar CRLH antenna 300 may resonate at approximately 1.73 GHz~2.6 GHz as shown in FIG. 22. That is, the planar CRLH antenna 300 may be used in a Personal Communication System (PCS), a Digital Cross-Connect System (DCS), WCDMA, or World Interoperbility for Microwave Access (WiMax).

Figure 23:
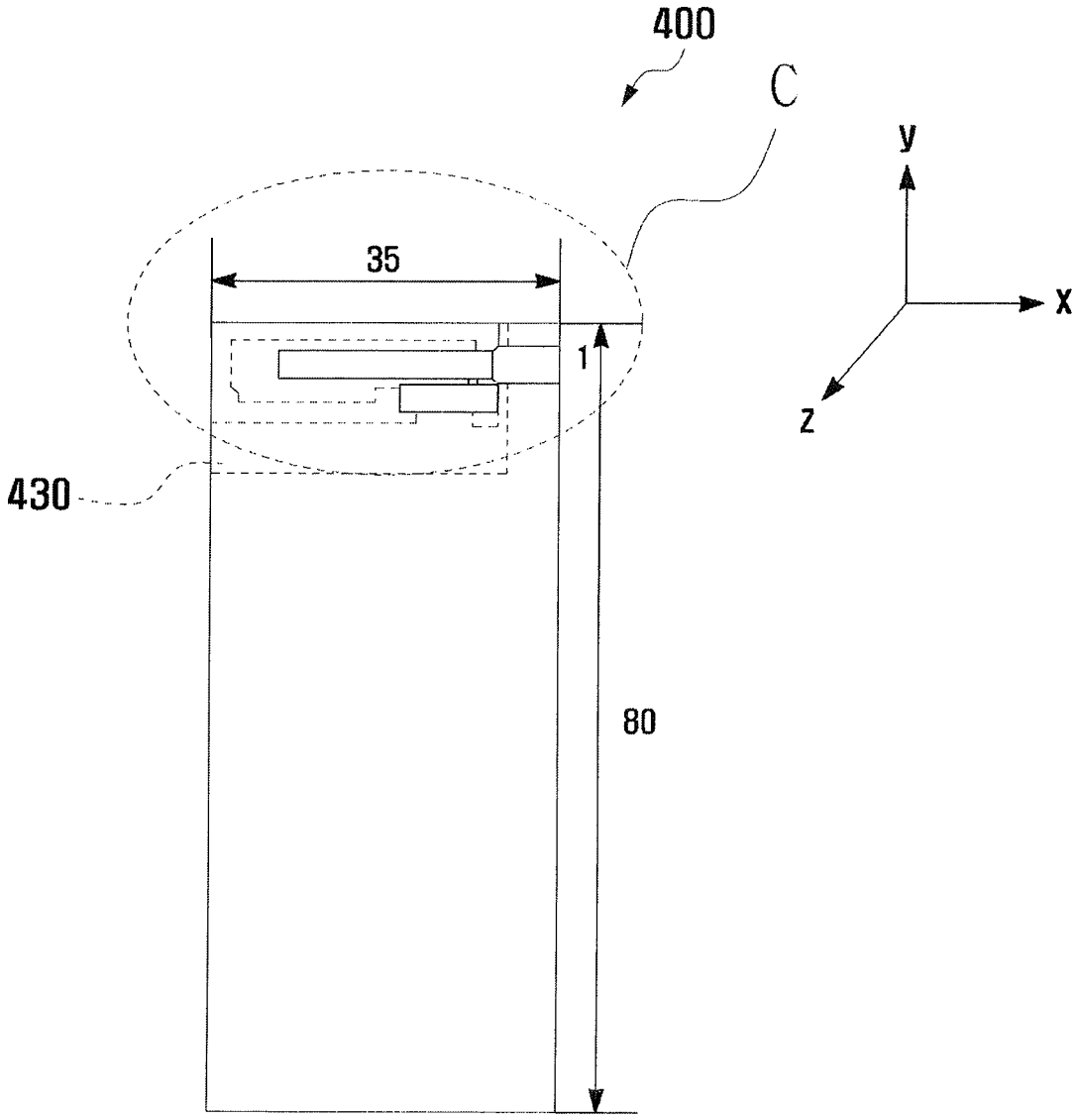
FIG. 23 is a view illustrating a structure of a planar CRLH antenna according to a fourth embodiment of the present invention.
Figure 24:
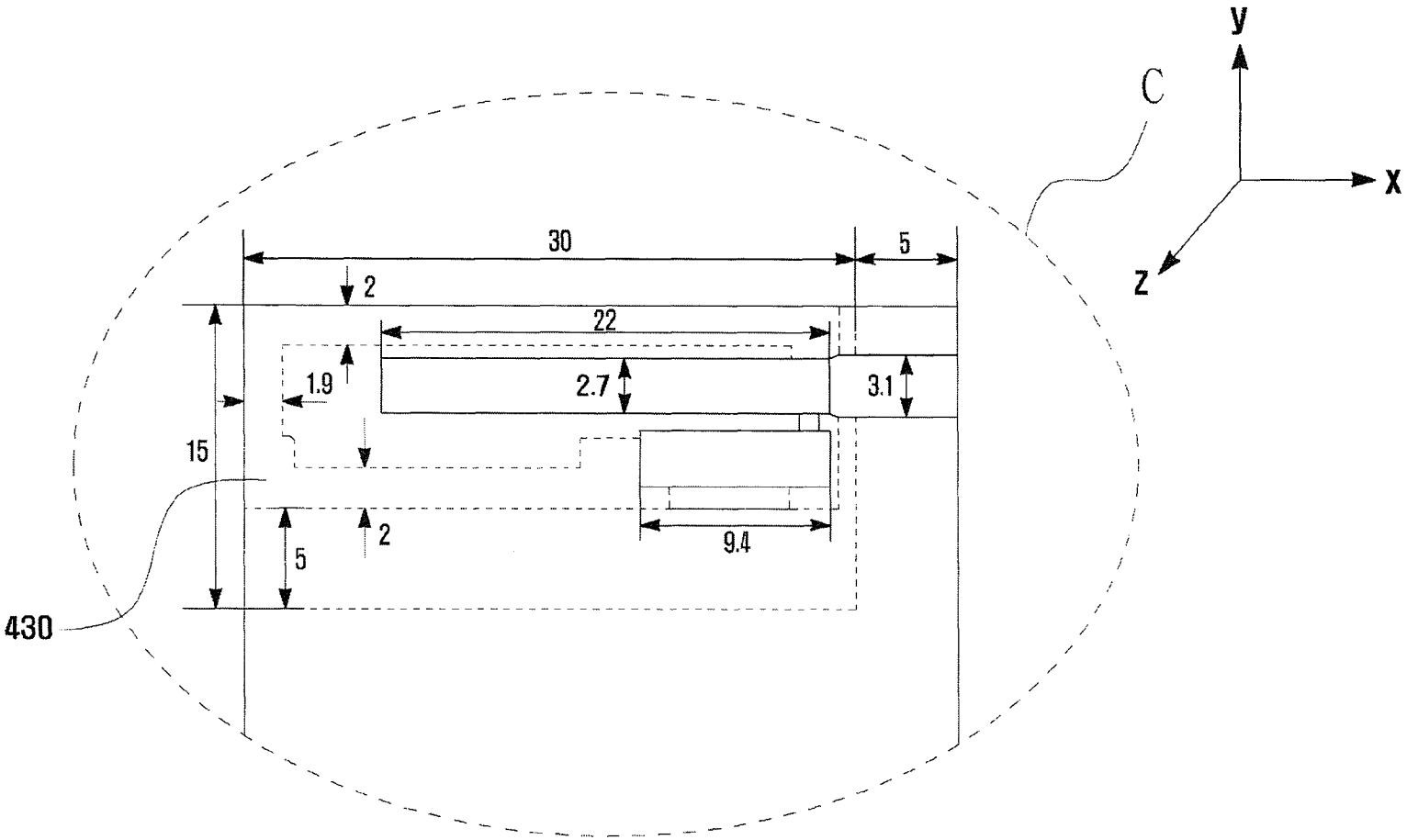
FIG. 24 is an enlarged view illustrating an area 'C' shown in FIG. 23.
Figure 25:
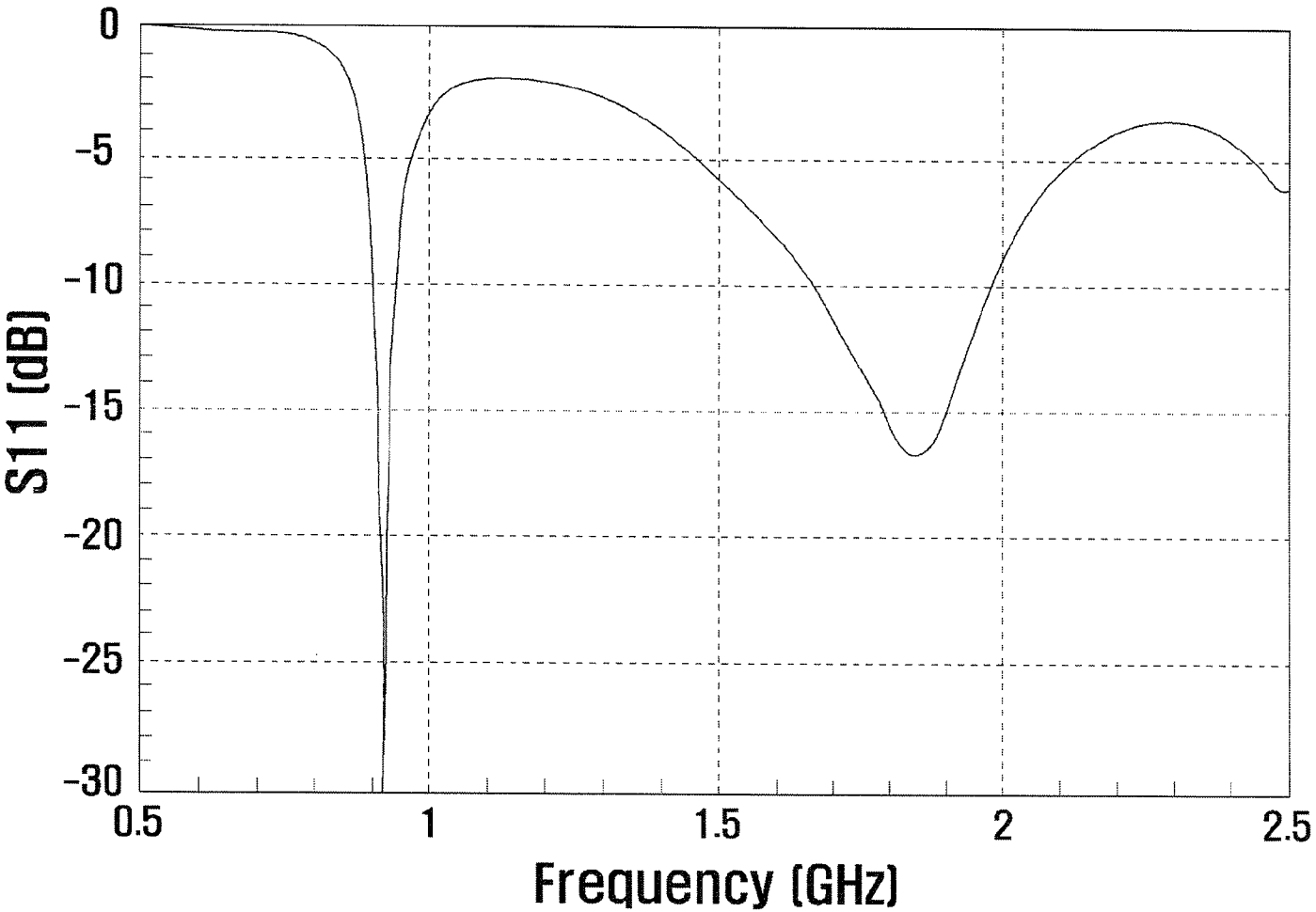
FIG. 25 is a graph illustrating change in an S parameter upon operation of FIG. 23.

FIG. 23 is a view illustrating a structure of a planar CRLH antenna according to a fourth embodiment of the present invention. FIG. 24 is an enlarged view illustrating a 'C' area shown in FIG. 23. FIG. 25 is a graph illustrating change in an S parameter upon operation of FIG. 23.

Referring to FIG. 23 and FIG. 24, the fundamental construction of the planar CRLH antenna 400 is identical to that shown in the foregoing embodiment, and thus a detailed description thereof is omitted. However, the planar CRLH antenna 400 is implemented to have the size of 35 mm×80 mm×0.8 mm, and a radiation line 430 of the planar CRLH antenna 400 is implemented to have a y direction length of 12 mm and an x direction length of 30 mm.

That is, when determining change in an S parameter based on −9.4 dB, the planar CRLH antenna 300 may resonate at approximately 0.90 GHz~0.98 GHz 1.67 GHz~2.16 GHz as shown in FIG. 25. Here, although not shown, operation efficiency of the planar CRLH antenna 400 is 77% at 0.90 GHz~0.98 GHz and 86% at 1.67 GHz 2.16 GHz. That is, the planar CRLH antenna 400 may be used in a GSM, a PCS, a DCS, or WCDMA.

Figure 26:
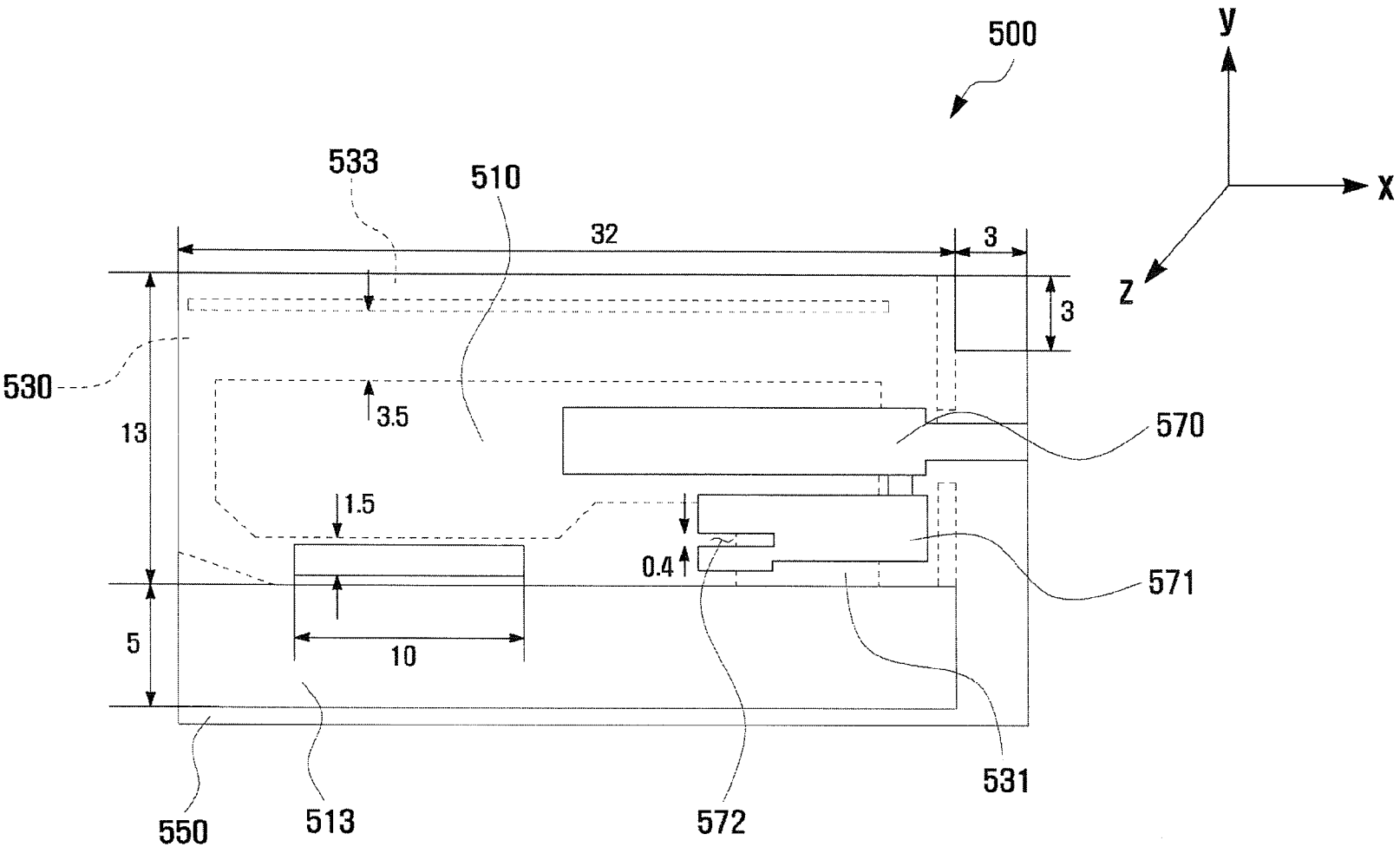
FIG. 26 is a view illustrating a structure of a planar CRLH antenna according to a fifth embodiment of the present invention.
Figure 27:
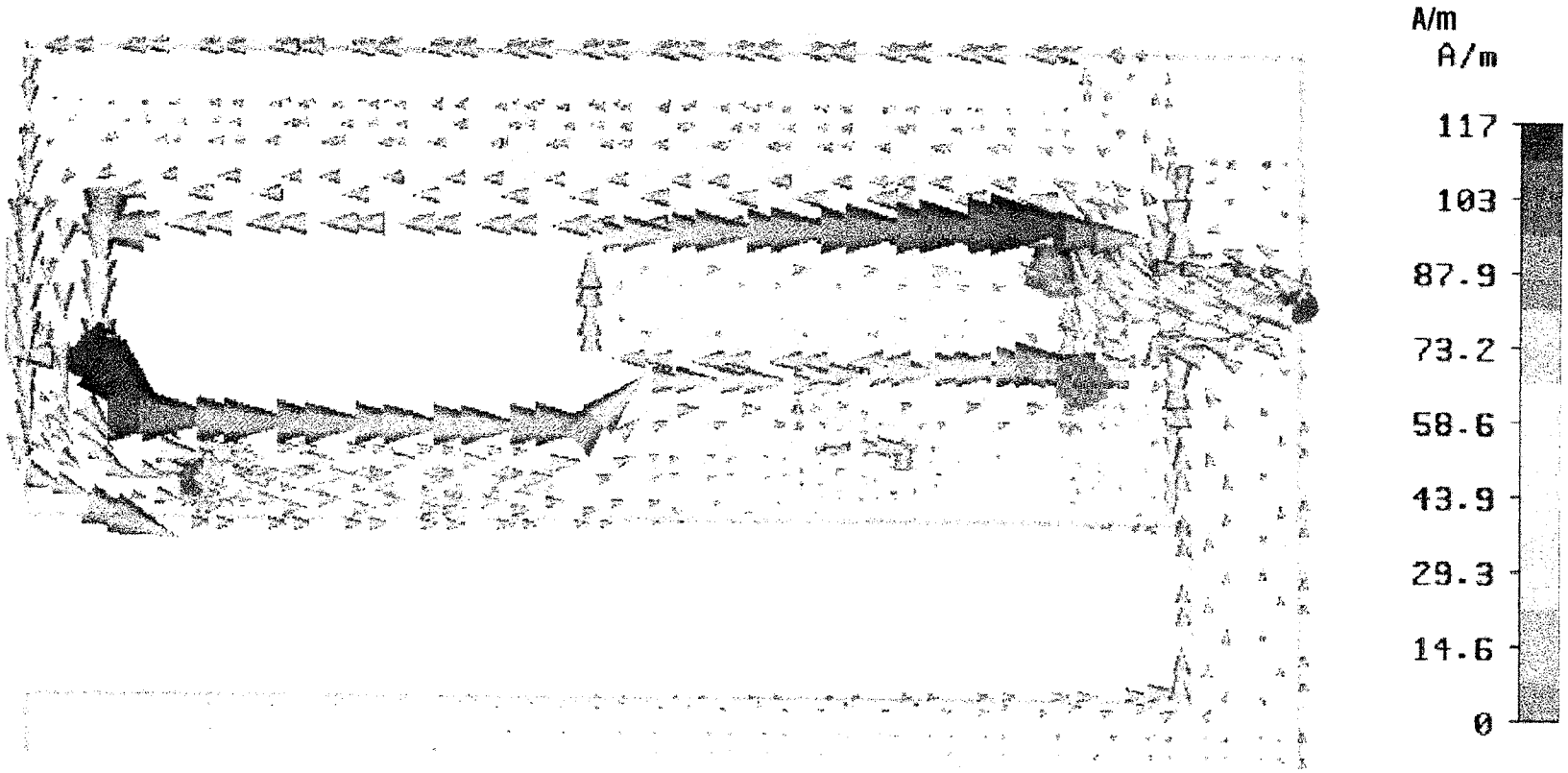
FIG. 27 is a view illustrating the current distribution upon operation of FIG. 26.
Figure 28:
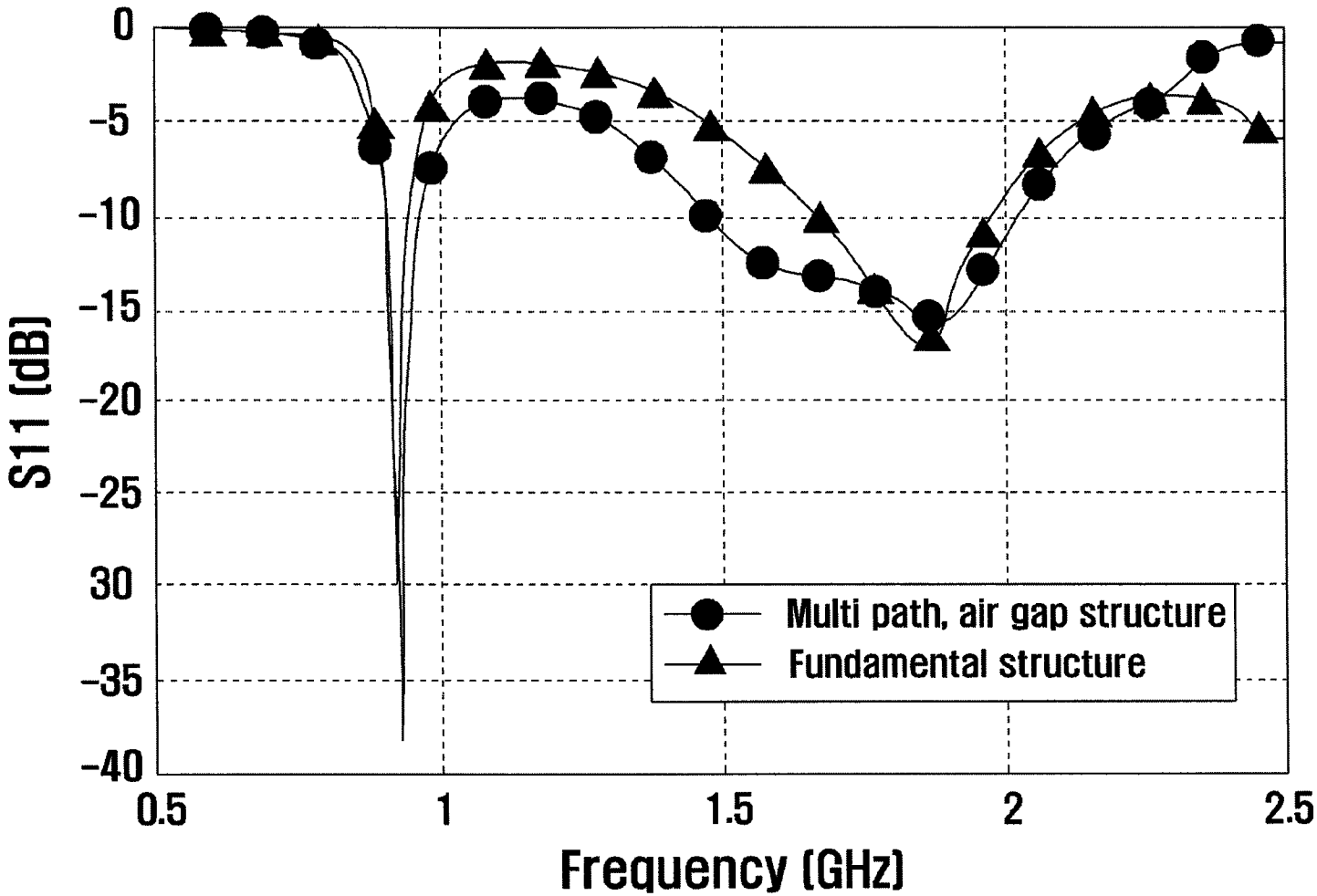
FIG. 28 is a graph illustrating change in an S parameter upon operation of FIG. 26.

Meanwhile, this may change a frequency band resonated at the planar CRLH antenna according to the foregoing embodiment by changing the size of the planar CRLH antenna. FIG. 26 to FIG. 28 show examples thereof, and illustrate a fifth embodiment of the present invention.

FIG. 26 is a view illustrating a structure of a planar CRLH antenna according to a fifth embodiment of the present invention. FIG. 27 is a view illustrating a current distribution upon operation of FIG. 26. FIG. 28 is a graph illustrating change in an S parameter upon operation of FIG. 26.

Referring to FIG. 26, the fundamental construction of the planar CRLH antenna 500 is identical to that shown in the foregoing embodiment, and thus a detailed description thereof is omitted. However, the planar CRLH antenna 500 is implemented by the size of 40 mm×40 mm×0.8 mm, and a radiation line 530 of the planar CRLH antenna 500 is implemented by 13 mm of a y direction length and 32 mm of X direction length.

At this time, a substrate body 510 of a planar CRLH antenna 500 of this embodiment is provided with an air gap 513 from which dielectric materials are removed. Here, the air gap 513 is formed between a radiation line 530 and a ground unit 550. The radiation line 530 may be cut-off from a peripheral environment through the air gap 513. Further, the planar CRLH antenna 500 includes a branch line 533 protruded and extended from the radiation line 530. At this time, when electric power is fed, the branch line 533 resonates with the radiation line 530. Further, in the planar CRLH antenna 500 of this embodiment, a branch division groove 572 is formed at one end of a resonation line 571 of a feeder line 570. That is, the resonation line 571 is divided into two branches based on the branch division groove 572. At this time, when electric power is fed, the resonation line 571 integrally resonates.

That is, when a voltage from a source is applied to the planar CRLH antenna 500, an electric current flows to the radiation line 530 through the feeder line 570 as shown in FIG. 27. When determining change in an S parameter based on −6 dB, the planar CRLH antenna 500 may resonate at the range of approximately 0.88 GHz 1.00 GHz and 1.33 GHz~2.14 GHz. Although not shown, operation efficiency of the planar CRLH antenna 500 indicates 90% at 0.88 GHz~1.00 GHz and 89% at 1.33 GHz~2.14 GHz. In other words, the planar CRLH antenna 500 may resonate at a frequency band of an expanded width by the air gap 513, the branch line 533, or the branch division groove 572.

Meanwhile, the foregoing embodiment has illustrated that the planar CRLH antenna is implemented by disposing a singe combination of the radiation line, the ground unit, and the feeder line at a substrate body. The present invention is not limited thereto. That is, although plural combinations of the radiation line, the ground unit, and the feeder line are disposed at the substrate body in the planar CRLH antenna, the present invention may be implemented. For example, respective combinations may be disposed at four corners of a substrate body having a square shape in the planar CRLH antenna in a lattice structure.

Therefore, the planar CRLH antenna of the present invention is small in size, and expands a radiation area, thereby expanding an available frequency band, or using a double frequency band. A branch line may be added to the planar CRLH antenna to expand an available frequency band. Further, a branch division groove may be added to a resonation line in the planar CRLH antenna to expand an available frequency band. Moreover, an air gap is formed between a radiation line and a ground unit in the planar CRLH antenna to expand an available frequency band.

Furthermore, in the planar CRLH antenna impedance matching may be easily controlled by adjusting the size of a ground unit or the size of a feeder line, in particular, the size of a matching line. In the planar CRLH antenna, a dual frequency band may be used by adjusting the size of a connection line for connecting a resonation line to a matching line or adding an inductor. In addition, in the planar CRLH antenna, a dual frequency band may be used by adjusting a location of a connection line or changing an overlapping area between a resonation line and a radiation line.

Although exemplary embodiments of the present invention have been described in detail hereinabove, it should be clearly understood that many variations and modifications of the basic inventive concepts herein taught which may appear to those skilled in the present art will still fall within the spirit and scope of the present invention, as defined in the appended claims.

What is claimed is:

1. A planar composite right/left handed (CRLH) antenna, comprising:

a substrate body which is made of dielectric materials, and which has a planer structure;

a radiation line which is formed on one side of the substrate body, and which is bent to form a slot for exposing a predetermined width of the substrate body through both ends thereof, and which resonates at a predetermined frequency band when fed; and a feeder line which is formed on the other side of the substrate body, which extends across the slot, and which feeds electric power to the radiation line.

2. The planar CRLH antenna of claim 1, further comprising a ground unit disposed at one side of the substrate body, contacting one end of the radiation line to ground the radiation line, and spaced apart from the other end of the radiation line, wherein the feeder line extends from the ground unit to the other end of the radiation line on the other side of the substrate body to overlap with the other end of the radiation line.

3. The planar CRLH antenna of claim 1, wherein the feeder line comprises:

a resonation line extending across the slot, overlapping with the radiation line at both ends thereof, and resonating at a frequency band different from the frequency band when electric power is fed; and a matching line formed in the substrate body as the radiation being bent, being disposed from the radiation line to extend to a device open region connecting with the slot, providing electric power to the radiation line and the resonation line, and matching impedance of the radiation line with a preset value.

4. The planar CRLH antenna of claim 3, wherein the matching line overlaps with the radiation line.

5. The planar CRLH antenna of claim 3, wherein the feeder line comprises an inductor connecting the matching line to the resonation line.

6. The planar CRLH antenna of claim 3, further comprising a connection line connecting the matching line to the resonation line.

7. The planar CRLH antenna of claim 4, further comprising a ground unit disposed at one side of the substrate body, contacting the radiation line to ground the radiation line, wherein the matching line extending from the ground unit to the device open region through the radiation line on the other side of the substrate body.

8. The planar CRLH antenna of claim 2, wherein an air gap from which the dielectric materials are removed is formed between the radiation line and the ground unit in the substrate body.

9. The planar CRLH antenna of claim 2, further comprising a branch line protruding and extending from the radiation line.

10. The planar CRLH antenna of claim 7, wherein a branch division groove is formed at one end of the resonation line, and the resonation line is divided into two branches based on the branch division groove.

11. The planar CRLH antenna of claim 2, wherein the radiation line has a 'ㄷ' shape.

12. The planar CRLH antenna of claim 11, wherein the feeder line has a 'ㄷ' shape, a 'C' shape, or a 'ㄹ' shape.

13. The planar CRLH antenna of claim 7, wherein an air gap from which the dielectric materials are removed is formed between the radiation line and the ground unit in the substrate body.

14. The planar CRLH antenna of claim 4, further comprising a branch line protruding and extending from the radiation line.

15. The planar CRLH antenna of claim 7, wherein the radiation line has a 'ㄷ' shape.

* * * * *